United States Patent [19]

Ogawa et al.

[11] Patent Number: 4,522,905

[45] Date of Patent: Jun. 11, 1985

[54] AMORPHOUS SILICON PHOTOCONDUCTIVE MEMBER WITH INTERFACE AND RECTIFYING LAYERS

[76] Inventors: Kyosuke Ogawa; Shigeru Shirai; Junichiro Kanbe; Keishi Saitoh; Yoichi Osato; Teruo Misumi, all of c/o Canon Kabushiki Kaisha, 30-2, 3-chome, Shimomaruko, Ohta-ku, Tokyo, Japan

[21] Appl. No.: 462,895

[22] Filed: Feb. 1, 1983

[30] Foreign Application Priority Data

| | | | |
|---|---|---|---|
| Feb. 5, 1982 | [JP] | Japan | 57-17210 |
| Feb. 5, 1982 | [JP] | Japan | 57-17211 |
| Feb. 5, 1982 | [JP] | Japan | 57-17212 |
| Feb. 9, 1982 | [JP] | Japan | 57-16583 |
| Feb. 24, 1982 | [JP] | Japan | 57-28376 |
| Feb. 24, 1982 | [JP] | Japan | 57-28377 |
| Feb. 24, 1982 | [JP] | Japan | 57-28378 |
| Feb. 24, 1982 | [JP] | Japan | 57-28379 |

[51] Int. Cl.[3] ..... G03G 5/082; G03G 5/14; G03G 5/09

[52] U.S. Cl. ..... 430/60; 430/57; 430/63; 430/65; 252/501.1; 427/74; 357/2

[58] Field of Search ..... 430/57, 60, 63, 65; 252/501.1; 427/74; 357/2

[56] References Cited

U.S. PATENT DOCUMENTS

| | | | |
|---|---|---|---|
| 3,210,184 | 10/1965 | Uhlig | 430/65 |
| 4,064,521 | 12/1977 | Carlson | 357/02 |
| 4,217,374 | 8/1980 | Ovshinsky et al. | 430/84 X |
| 4,226,898 | 10/1980 | Ovshinsky et al. | 430/84 X |
| 4,251,289 | 2/1981 | Moustakas et al. | 204/192 |
| 4,253,882 | 3/1981 | Dalal | 427/74 X |
| 4,265,991 | 5/1981 | Hirai et al. | 430/65 X |
| 4,289,822 | 9/1981 | Shimada et al. | 427/74 X |
| 4,317,844 | 3/1982 | Carlson | 427/39 |
| 4,328,258 | 5/1982 | Coleman | 427/39 |
| 4,359,512 | 11/1982 | Fukuda et al. | 430/57 |
| 4,359,514 | 11/1982 | Shimizu et al. | 430/65 |
| 4,378,417 | 3/1983 | Maruyama et al. | 430/57 |
| 4,394,426 | 7/1983 | Shimizu et al. | 430/60 X |
| 4,409,308 | 10/1983 | Shimizu et al. | 430/60 |

FOREIGN PATENT DOCUMENTS

| | | | |
|---|---|---|---|
| 56-25743 | 3/1981 | Japan | 430/57 |
| 56-64347 | 6/1981 | Japan | 430/57 |

*Primary Examiner*—Roland E. Martin

[57] ABSTRACT

A photoconductive member comprises a support for photoconductive member, an interface layer constituted of an amorphous material containing at least silicon atoms and nitrogen atoms as constituent atoms, a rectifying layer comprising an amorphous material containing atoms (A) belonging to the group III or the group V of the periodic table as constituent atoms in a matrix of silicon atoms and an amorphous layer exhibiting photoconductivity constituted of an amorphous material containing at least one of hydrogen atoms or halogen atoms as constituent atoms in a matrix of silicon atoms, said rectifying layer having a layer thickness t which from 30 Å up to, but not reaching, 0.3$\mu$ and the content C(A) of the aforesaid atoms contained in the rectifying layer being 30 atomic ppm or more, or said t being 30 Å or more and said C(A) being from 30 atomic ppm up to, but not reaching, 100 atomic ppm.

19 Claims, 8 Drawing Figures

AMORPHOUS SILICON PHOTOCONDUCTIVE MEMBER WITH INTERFACE AND RECTIFYING LAYERS

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, x-rays, gamma-rays, and the like).

2. Description of the Prior Arts

Photoconductive materials, which constitute solid state image pick-up devices, image forming members for electrophotography in the field of image formation, or photoconductive layers in manuscript reading devices, are required to have a high sensitivity, a high SN ratio (Photocurrent ($I_p$)/Dark current ($I_d$)), spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 an application of a-Si for use in a photoelectroconverting reading device.

However, under the present situation, the photoconductive members having photoconductive layers constituted of a conventional a-Si are further required to be improved in various aspects including electrical, optical and photoconductive characteristics such as dark resistance value, photosensitivity and response to light, etc., and environmental characteristics during use, further stability with lapse of time, and durability.

For instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so called ghost phenomenon wherein residual images are formed.

Further, a-Si materials may contain as constituent atoms hydrogen atoms or halogen atoms such as fluorine atoms, chlorine atoms. etc. for improving their electrical, photoconductive characteristics, boron atoms, phosphorous atoms, etc. for controlling the electroconduction type as well as other atoms for improving other characteristics. Depending on the manner in which these constituent atoms are contained, there may sometimes be caused problems with respect to electrical, photoconductive characteristics or dielectric strength, and further durability of the layer formed.

That is, for example, in many cases, the life of the photocarriers generated by light irradiation in the photoconductive layer formed is insufficient, or at the dark portion, the charges injected from the support side cannot sufficiently be impeded.

Further, when the layer thickness becomes ten and several microns, there is a tendency to cause such phenomena as loosening or peeling of the layer off from the surface of the support or formation of cracks in the layer with lapse of time when left to stand in the air after taken out from the vacuum deposition chamber for layer formation. These phenomena will occur frequently particularly in case of a drum-shaped support to be used conventionally in the field of electrophotography. Thus, there is the problem to be solved with respect to stability with lapse of time.

Thus, it is required in designing of a photoconductive material to make efforts to solve the above-mentioned problems along wih the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. It has now been found that a photoconductive member having a photoconductive layer comprising an amorphous layer exhibiting photoconductivity, which is constituted of so-called hydrogenated amorphous silicon, halogenated amorphous silicon or halogen-containing hydrogenated amorphous silicon which is an amorphous material containing at least one of hydrogen atom (H) and halogen atom (X) in a matrix of a-Si, especially silicon atoms (hereinafter referred to comprehensively as a-Si(H,X)), said photoconductive member being prepared by designing so as to have a specific structure, is found to exhibit not only practically extremely excellent characteristics but also surpass the photoconductive members of the prior art in substantially all respects, especially markedly excellent characteristics as a photoconductive member for electrophotography. The present invention is based on such finding.

SUMMARY OF THE INVENTION

A primary object of the present invention is to provide a photoconductive member which is markedly excellent in light fatigue resistance, excellent in durability without causing deterioration phenomenon when used repeatedly and entirely or substantially free from residual potential observed.

Another object of the present invention is to provide a photoconductive member which is excellent in adhesion between a support and a layer provided on the support or between respective laminated layers, stable with closeness of structural arrangement and high in layer quality.

Still another object of the present invention is to provide a photoconductive member having an ability to retain charges during charging treatment for formation of electrostatic images, when applied as a member for formation of an electrophotographic image and having excellent electrophotographic characteristics, for which ordinary electrophotographic methods can bery effectively be applied.

Still another object of the present invention is to provide a photoconductive member for electrophotography capable of providing easily a high quality image which is high in density, clear in halftone and high in resolution.

Further, still another object of the present invention is to provide a photoconductive member which comprises a support for photoconductive member, an interface layer constituted of an amorphous material containing at least silicon atoms and nitrogen atoms as constituent atoms, a rectifying layer constituted of an amorphous material containing atoms (A) belonging to the group III or the group V of the periodic table as constituent atoms in a matrix of silicon atoms and an amorphous layer exhibiting photoconductivity constituted of an amorphous material containing at least one of hydrogen atoms or halogen atoms as constituent atoms in a matrix of silicon atoms, said rectifying layer having a layer thickness t from 30 Å up to, but not reaching, 0.3μ and the content C(A) of the aforesaid atoms contained in the rectifying layer being 30 atomic ppm or more, or said t being 30 Å or more and said C(A) being from 30 atomic ppm up to, but not reaching, 100 atomic ppm.

DESCRIPTION OF THE PREFERRED EMBODIMENTS

Figure 1:
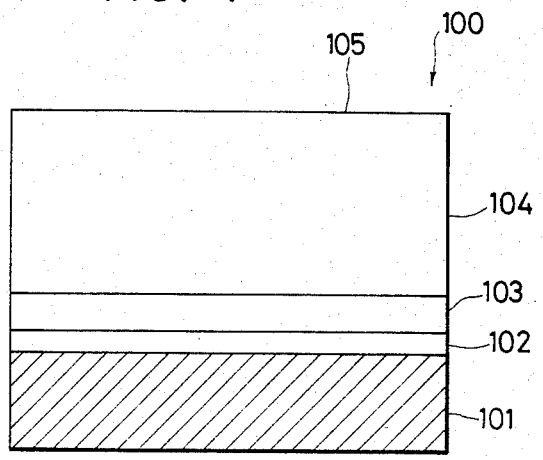
FIG. 1 through FIG. 4 show schematic sectional views for illustration of the layer constitutions of preferred embodiments of the photoconductive member according to the present invention, respectively.

FIG. 1 shows a schematic sectional view for illustration of a typical exemplary constitution of the photoconductive member of this invention.

The photoconductive member 100 as shown in FIG. 1 is provided with an interface layer 102, a rectifying layer 103 and an amorphous layer 104 having photoconductivity on a support 101 for photoconductive member, said amorphous layer 104 having a free surface 106. The interface layer 102 is provided primarily for the purpose of enhancement of adhesion between the support 101 and the rectifying layer 103, and it is constituted of a material as hereinafter described so that it may have affinities for both the support 101 and the rectifying layer 103.

The rectifying layer 103 has a function primarily of preventing effectively injection of charges from the side of the support 101 into the amorphous layer 104. The amorphous layer 104 has a function to receive irradiation of a light to which it is sensitive thereby to generate photocarriers in said layer 104 and transport said photocarriers in a certain direction.

The interface layer in the present invention is constituted of an amorphous material containing silicon atoms and nitrogen atoms, optionally together with at least one of hydrogen atoms (H) or halogen atoms (X), as constituent atoms (hereinafter written as a-SiN(H, X)).

As a-SiN(H, X), there may be included an amorphous material containing nitrogen atoms (N) as constituent atoms in a matrix of silicon atoms (Si) (hereinafter written as "a-$Si_aN_{1-a}$"), an amorphous material containing nitrogen atoms (N) and hydrogen atoms (H) as constituent atoms in a matrix of silicon atoms (Si) (hereinafter written as "a-$(Si_bN_{1-b})_cH_{1-c}$") and an amorphous material containing nitrogen atoms (N) and halogen atoms (X), optionally together with hydrogen atoms (H), as constituent atoms in a matrix of silicon atoms (Si) (hereinafter written as "a-$(Si_dN_{1-d})_e$ (H, X)$_{1-e}$").

In the present invention, illustrative as the halogen atom (X) to be optionally incorporated in the interface layer are fluorine, chlorine, bromine and iodine, of which fluorine and chlorine are particularly preferred.

As the method for layer formation in case of constituting an interface layer of the above amorphous layer, there may be employed the glow discharge method, the sputtering method, the ion implantation method, the ion plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms and nitrogen atoms, optionally together with hydrogen atoms or halogen atoms, into the interface layer to be prepared, there may preferably be employed the glow discharge method or the sputtering method.

Further, in the present invention, the interface layer may be formed by using the glow discharge method and the sputtering method in combination in the same device system. For formation of an interface layer constituted of a-SiN(H, X) according to the glow discharge method, the basic procedure comprises introducing a starting gas capable of supplying silicon atoms (Si) and a starting gas for introduction of nitrogen atoms (N), optionally together with starting gases for introduction of hydrogen atoms (H) and/or for introduction of halogen atoms (X), into a deposition chamber which can be internally brought to a reduced pressure, and exciting glow discharge in said deposition chamber, thereby forming an interface layer comprising a-SiN(H, X) on the surface of a given support located at a predetermined position.

Formation of the interface layer according to the sputtering method may be carried out according to, for example, the following procedures.

According to the first procedure, in carrying out sputtering of a target constituted of Si in an atmosphere of an inert gas such as Ar, He and the like or a gas mixture based on these gases, a starting gas for introduction of nitrogen atoms (N) optionally together with gases for introduction of hydrogen atoms (H) and/or for introduction of halogen atoms (X) may be introduced into a vacuum deposition chamber in which sputtering is to be effected.

According to the second procedure, nitrogen atoms (N) can be introduced into the interface layer to be formed by use of a target constituted of $Si_3N_4$ or two sheets of targets constituted of Si and of $Si_3N_4$, or a target constituted of Si and $Si_3N_4$. During this operation, the aforesaid starting gas for introduction of nitrogen atoms (N) can be used in combination, whereby the content of the nitrogen atoms (N) to be incorporated into the interface layer can freely be controlled as desired by controlling the flow rate of said gas.

The content of the nitrogen atoms (N) to be incorporated into the interface layer may be controlled freely as desired by controlling the flow rate of the starting gas for introduction of nitrogen atoms (N) when it is introduced into a deposition chamber, or adjusting the proportion of the nitrogen atoms (N) contained in a target for introduction of nitrogen atoms (N) during preparation of said target or conducting both of these methods.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular $SiH_4$ and $Si_2H_6$ are preferred with respect to easy handling during layer formation and efficiency for supplying Si.

By use of these starting materials, H can be introduced together with Si into the interface layer to be formed by appropriate selection of layer forming conditions.

As the effective starting material for supplying Si other than the above hydrogenated silicons, there may be mentioned silicon compounds containing halogen atoms (X), namely so called silane derivatives substituted by halogens. More specifically, preferable silicon halides may include $SiF_4$, $Si_2F_6$, $SiCl_4$, $SiBr_4$ and the like. Further, there may also be included gaseous or gasifiable halides containing hydrogen atoms as one of the constituent, hydrogenated silicons substituted by halogens, such as $SiH_2F_2$, $SiH_2I_2$, $SiH_2Cl_2$, $SiHCl_3$, $SiH_2Br_2$, and $SiHBr_3$ and the like, as the effective starting material for supplying Si for formation of the interface layer.

Also, in case when these silicon compounds containing halogen atoms (X) are to be used, X can be introduced together with Si into the interface layer to be formed by appropriate selection of layer forming conditions as described above. The halogenated silicon compounds containing halogen atoms among the above-mentioned starting materials may be used as preferable starting materials for introduction of halogen atoms (X) in the present invention, because hydrogen atoms (H) very effective for controlling electric or photoelectric characteristics can be introduced simultaneously with introduction of halogen atoms (X).

Typical examples of the starting materials effectively useful as the starting gas for introduction of halogen atoms (X) in forming an interface layer in the present invention may include, in addition to those mentioned above, halogen gases such as of fluorine, chlorine, bromine or iodine, inerhalogen compounds such as BrF, ClF, $ClF_3$, $BrF_5$, $BrF_3$, $IF_3$, $IF_7$, ICl, IBr, etc. and hydrogen halides such as HF, HCl, HBr, HI and the like.

As the starting materials which can be effectively used as starting gases for introduction of nitrogen atoms in formation of an interface layer, there may be mentioned gaseous or gasifiable nitrogen compounds constituted of N or N and H such as nitrogen, nitrides and azides, including for example nitrogen ($N_2$), ammonia ($NH_3$), hydrazine ($H_2NNH_2$), hydrogen azide ($NH_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), nitrogen tetrafluoride ($F_4N_2$) and the like.

In the present invention, as the diluting gas to be used in formation of an interface layer according to the glow discharge method or the sputtering method, there may be included, for example, so called rare gases such as He, Ne, Ar and the like as preferable ones.

The amorphous material a-SiN(H, X) constituting the interface layer of the present invention, because the function of the interface layer is to consolidate adhesion between the support and the rectifying layer and, in addition, to make electrical contact therebetween uniform, is desired to be carefully prepared by selecting strictly the conditions for preparation of the interface layer so that the interface layer may be endowed with the required characteristics as desired.

As an important factor among the layer forming conditions for formation of an interface layer comprising a-SiN(H, X) having the characteristics adapted for the objects of the present invention, there may be mentioned the support temperature during layer formation.

That is, in forming an interface layer comprising a-SiN(H, X) on the surface of a support, the support temperature during layer formation is an important factor having influences on the structure and the characteristics of the layer to be formed. In the present invention, the support temperature during layer formation is desired to be strictly controlled so that a-SiN(H, X) having the intended characteristics may be prepared as desired.

The support temperature in forming the interface layer for accomplishing effectively the objects of the present invention, which should be selected within the optimum range in conformity with the method for formation of the interface layer to carry out formation of the interface layer, is desired to be generally 50° C. to 350° C., preferably 100° C. to 250° C. In practicing formation of the interface layer, it is also possible to form continuously from the interface layer to the rectifying layer, the amorphous layer, further other layers optionally formed on the amorphous layer, in the same system. Employment of the glow discharge method or the sputtering method is advantageous, because severe control of the composition ratio of the atoms constituting respective layers or control of the layer thicknesses can be done with relative ease as compared with other methods. When the interface layer is formed according to these layer forming methods, the discharging power and the gas pressure during layer formation may be mentioned as important factors similarly to the aforesaid support temperature which have influences on the characteristics of the interface layer to be prepared.

The discharging power condition for preparing effectively the interface layer having the characteristics for accomplishing the objects in the present invention with good productivity may preferably be 1 to 300 W, more preferably 2 to 150 W. The gas pressure in a deposition chamber may preferably be $3\times10^{-3}$ to 5 Torr, more preferably about $8\times10^{-3}$ to 0.5 Torr.

The content of nitrogen atoms (N), and the contents of hydrogen atoms (H) and halogen atoms (X) optionally contained in the interface layer in the photoconductive member of the present invention, are also important factors, similarly to the conditions for preparation of the interface layer, for forming the interface layer capable of providing the desired characteristics to accomplish the objects of the present invention.

Each of the contents of nitrogen atoms (N), hydrogen atoms (H) and halogen atoms (X) in the interface layer may be determined as desired while considering the layer preparation conditions as described above so that the objects of the present invention may be accomplished effectively.

When the interface layer is to be constituted of a-$Si_aN_{1-a}$, the content of nitrogen atoms (N) in the interface layer may generally by $1\times10^{-3}$ to 60 atomic %, more preferably 1 to 50 atomic %, namely in terms of representation by a, a being preferably 0.4 to 0.99999, more preferably 0.5 to 0.99.

When the interface layer is to be constituted of a-$(Si_bN_{1-b})_cH_{1-c}$, the content of nitrogen atoms (N) may preferably be $1\times10^{-3}$ to 55 atomic %, more preferably 1 to 55 atomic %, the content of hydrogen atoms (H) preferably 2 to 35 atomic %, more preferably 5 to 30 atomic %, namely in terms of representation by b and c, b being preferably 0.43 to 0.99999, more preferably 0.43 to 0.99 and c being preferably 0.65 to 0.98, more preferably 0.7 to 0.95. When the interface layer is to be constituted of a-$(Si_dN_{1-d})_e(H,X)_{1-e}$, the content of nitrogen atoms may preferably be $1\times10^{-3}$ to 60 atomic %, more preferably 1 to 60 atomic %, the content of halogen atoms or the total content of halogen atoms and hydrogen atoms preferably 1 to 20 atomic %, more preferably 2 to 15 atomic %, and the content of hydrogen atoms in this case preferably 19 atomic % or less, more preferably 13 atomic % or less. In terms of representation by d and e, d may preferably be 0.43 to 0.99999, more preferably 0.43 to 0.99, and e preferably 0.8 to 0.99, more preferably 0.85 to 0.98.

The interface layer constituting the photoconductive member in the present invention may have a layer thickness, which may suitably be determined depending on the layer thickness of the rectifying layer provided on said interface layer and the characteristics of the rectifying layer.

In the present invention, the interface layer may have a layer thickness preferably of 30 Å to 2μ, more preferably of 40 Å to 1.5μ, most preferably of 50 Å to 1.5μ.

The rectifying layer constituting the photoconductive member of the present invention comprises an amorphous material containing the atoms belonging to the group III of the periodic table (the group III atoms) or the atoms belonging to the group V of the periodic table (the group V atoms), preferably together with hydrogen atoms (H) or halogen atoms or both thereof, in a matrix of silicon atoms (Si) (hereinafter written as "a-Si(III, V, H, X)"), and its layer thickness t and the content C(A) of the group III atoms and the group V atoms are made to have values within the ranges as specified above.

In the rectifying layer of the present invention, the layer thickness t and the content C(A) of the atoms (A) belonging to the group III or the group V of the periodic table may be more preferably within the following ranges, namely:

40 Å $\leqq$ t $<$ 0.3μ and C(A) $\geqq$ 40 atomic ppm; or 40 atomic ppm $\leqq$ C(A) $<$ 100 atomic ppm and t $\geqq$ 40 Å, most preferably within the following ranges, namely:

50 Å $\leqq$ t $<$ 0.3μ and C(A) $>$ 50 atomic ppm; or 50 atomic ppm $\leqq$ C(A) $<$ 100 atomic ppm and t $\geqq$ 50 Å.

In the present invention, the atoms to be used as the atoms belonging to the group III of the periodic table contained in the rectifying layer may include B (boron), Al (aluminum), Ga (gallium), In (indium), Tl (thallium) and the like, particularly preferably B and Ga.

The atoms belonging to the group V of the periodic table contained in the rectifying layer may include P (phosphorus), As (arsenic), Sb (antimony), Bi (bismuth) and the like, particularly preferably P and As.

For formation of a rectifying layer comprising a-Si(III,V,H,X) there may be adopted the vacuum deposition method utilizing discharging phenomenon, such as the glow discharge method, the sputtering method or the ion-plating method, similarly to in formation of an interface layer.

For example, for formation of a rectifying layer constituted of a-Si(III,V,H,X) according to the glow discharge method, the basic procedure comprises introducing a starting gas capable of supplying the group III atoms or a starting gas capable of supplying the group V atoms, and optionally a starting gas for introduction of hydrogen atoms (H) and/or halogen atoms (X), together with a starting gas for supplying silicon atoms (Si), into a deposition chamber which can be internally brought to a reduced pressure, wherein glow discharge is excited thereby to form a layer comprising a-Si(III,V,H,X) on the surface of a support placed at a predetermined position in the chamber. When it is to be formed according to the sputtering method, a starting gas for introduction of the group III atoms or a starting gas for introduction of the group V atoms, optionally together with gases for introduction of hydrogen atoms and/or halogen atoms, may be introduced into the chamber into a deposition chamber for sputtering when effecting sputtering of a target constituted of Si in an atmosphere of an inert gas such as Ar, He or a gas mixture based on these gases.

As the starting materials which can be used as the starting gases for formation of the rectifying layer, there may be employed those selected as desired from the same starting materials as used for formation of the interface layer, except for the starting materials to be used as the starting gases for introduction of the group III atoms and the group V atoms.

For introducing the group III atoms or the group V atoms structurally into the rectifying layer, the starting material for introduction of the group III atoms or the starting material for introduction of the group V atoms may be introduced under gaseous state into a deposition chamber together with other starting materials for formation of the rectifying layer. As the material which can be used as such starting materials for introduction of the group III atoms or the group V atoms, there may be desirably employed those which are gaseous under the conditions of normal temperature and normal pressure, or at least readily gasifiable under layer forming conditions.

Illustrative of such starting materials for introduction of the group III atoms are boron hydrides such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like. In addition, there may also be included $AlCl_3$, $GaCl_3$, $Ga(CH_3)_3$, $InCl_3$, $TlCl_3$ and the like.

Illustrative of the starting materials for introduction of the group V atoms are phosphorus hydrides such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like, as effective materials for introduction of the group V atoms.

In the present invention, the group III atoms or the group V atoms to be contained in the rectifying layer for imparting rectifying characteristic may preferably be distributed substantially uniformly within planes parallel to the surface of the support and in the direction of the layer thickness.

In the present invention, the content of the group III atoms and the group V atoms to be introduced into the rectifying layer can be controlled freely by controlling the gas flow rate, the gas flow rate ratio of the starting materials for introduction of the group III atoms and the group V atoms, the discharging power, the support temperature, the pressure in the deposition chamber and others.

In the present invention, as the halogen atoms (X), which may be introduced into the rectifying layer, if necessary, there may be included those as mentioned above concerning description about the interface layer.

In the present invention formation of an amorphous layer constituted of a-Si(H,X) may be conducted by the vacuum deposition method utilizing discharging phenomenon, such as the glow discharge method, the sputtering method or the ion-plating method similarly to in formation of an interface layer. For example, for formation of an amorphous layer constituted of a-Si(H,X) according to the glow discharge method, the basic procedure comprises introducing a starting gas capable of supplying a starting gas for introduction of hydrogen atoms (H) and/or halogen atoms (X) together with a starting gas for supplying silicon atoms (Si), into a deposition chamber which can be internally brought to a reduced pressure, wherein glow discharge is excited thereby to form a layer comprising a-Si(H,X) on the surface of a rectifying layer on a support placed at a predetermined position in the chamber. When it is to be formed according to the sputtering method, a starting gas for introduction of hydrogen atoms (H) and/or halogen atoms (X) may be introduced into the chamber into a deposition chamber for sputtering when effecting sputtering of a target constituted of Si in an atmosphere of an inert gas such as Ar, He or a gas mixture based on these gases.

In the present invention, as the halogen atoms (X), which may be introduced into the amorphous layer, if necessary, there may included those as mentioned above concerning description about the interface layer.

The starting gas for supplying Si to be used for formation of an amorphous layer in the present invention may include gaseous or gasifiable hydrogenated silicons (silanes) such as $SiH_4$, $Si_2H_6$, $Si_3H_8$, $Si_4H_{10}$ and others as mentioned in description about the interface layer or the rectifying layer as effective materials. In particular, $SiH_4$ and $Si_2H_6$ are preferred with respect to easy handling during formation and efficiency for supplying Si.

As the effective starting gas for incorporation of halogen atoms to be used in the present invention for formation of an amorphous layer, there may be employed a number of halogen compounds similarly as in case of an interface layer, including gaseous or gasifiable halogen compounds such as halogen gases, halides, interhalogen compounds, silane derivatives substituted by halogens and the like.

Further, there may be also included gaseous or gasifiable silicon compounds containing halogen atoms, which comprises silicon atoms (Si) and halogen atoms (X) as constituents, as effective materials to be used in the present invention.

In the present invention, the amount of hydrogen atoms (H) or halogen atoms (X) or the sum (H+X) of hydrogen atoms (H) and halogen atoms (X) to be contained in the rectifying layer or the amorphous layer is desired to be in the range preferably from 1 to 40 atomic %, more preferably from 5 to 30 atomic %. For controlling the amount of hydrogen atoms (H) and/or halogen atoms (X) to be contained in the rectifying layer or in the amorphous layer, for example, the support temperature, the amount of the starting material to be used for incorporation of hydrogen atoms (H) or halogen atoms (X), discharging power and others may be controlled.

In the present invention, as diluting gases to be used in formation of the amorphous layer according to the glow discharge method or as gases for sputtering during formation according to the sputtering method, there may be employed so called rare gases such as He, Ne, Ar and the like.

In the present invention, the amorphous layer may have a layer thickness, which may be suitably determined depending on the characteristics required for the photoconductive member prepared, but desirably within the range generally from 1 to 100$\mu$, preferably 1–80$\mu$, most preferably 2 to 50$\mu$.

In the present invention, when the group V atoms are to be incorporated in the rectifying layer, it is desirable that the conduction characteristic of said layer is controlled freely by incorporating a substance for controlling the conduction characteristic different from the group V atoms in the amorphous layer.

As such a substance, there may be preferably mentioned the so called impurities in the field of semiconductors, preferably p-type impurities for imparting p-type conduction characteristic to a-Si(H,X) constituting the amorphous layer to be formed in the present invention, typically the atoms belonging to the aforesaid group III of the periodic table (the group III atoms).

In the present invention, the content of the substance for controlling the conduction characteristic in the amorphous layer may be selected suitably in view of organic relationships with the conduction characteristic required for said amorphous layer, the characteristics of other layers provided in direct contact with said layer, the characteristic at the contacted interface with said other layers, etc.

In the present invention, the content of the substance for controlling the conduction characteristic in the amorphous layer is desired to be generally 0.001 to 1000 atomic ppm, preferably 0.05 to 500 atomic ppm, most preferably 0.1 to 200 atomic ppm.

The support to be used in the present invention may be either electroconductive or insulating. As the electroconductive support, there may be mentioned metals such as NiCr, stainless steel, Al, Cr, Mo, Au, Nb, Ta, V, Ti, Pt, Pd etc. or alloys thereof.

As insulating supports, there may conventionally be used films or sheets or synthetic resins, including polyesters, polyethylene, polycarbonates, cellulose acetate, polypropylene, polyvinyl chloride, polyvinylidene chloride, polystyrene, polyamides, etc., glasses, ceramics, papers and so on. These insulating supports may preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the suppot is made as thin as possible, so far as the function of a support can be exhibited. However, in such a case, the thickness is generally 10μ or more from the points of fabrication and handling of the support as well as its mechanical strength.

Figure 2:
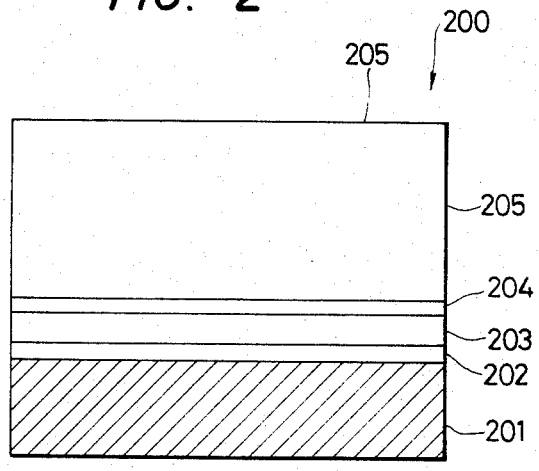

FIG. 2 shows the second preferred embodiment of the photoconductive member of the present invention.

The photoconductive member 200 shown in FIG. 2 is different from the photoconductive member 100 shown in FIG. 1 in having an upper interface layer 204 between the rectifying layer 203 and the amorphous layer 205 exhibiting photoconductivity.

That is, the photoconductive member 200 is provided with a support 201, and, consecutively laminated on said support 201, a lower interface layer 202, a rectifying layer 203, an upper interface layer 204 and an amorphous layer 205, the amorphous layer 205 having a free surface 206.

The upper interface layer 204 has the function of consolidating adhesion between the rectifying layer 203 and the amorphous layer 205 thereby to make electrical contact at the interface of both layers uniform, while concomitantly making tough the layer quality of the rectifying layer 203 by being provided directly on the rectifying layer 203.

The lower interface layer 202 and the upper interface layer 204 constituting the photoconductive member 200 as shown in FIG. 2 are constituted of the same amorphous material as in case of the interface layer 102 constituting the photoconductive member 100 as shown in FIG. 1 and may be formed according to the same preparation procedure under the same conditions so that similar characteristics may be imparted thereto. The rectifying layer 203 and the amorphous layer 205 have also the same characteristics and functions as the rectifying layer 103 and the amorphous layer 104, respectively, and may be formed according to the same layer preparation procedure under the same conditions as in case of FIG. 1.

Figure 3:
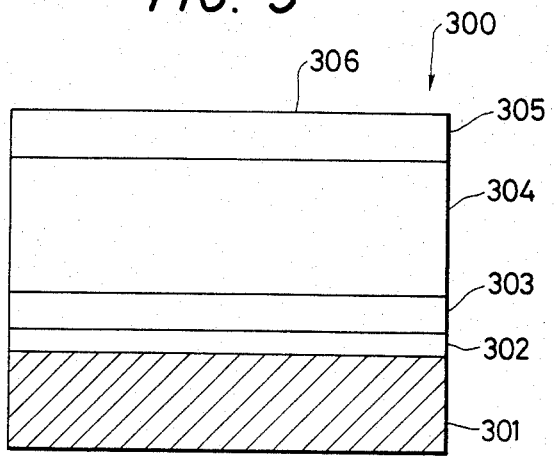

FIG. 3 is a schematic illustration of the layer constitution of the third embodiment of the photoconductive member of the present invention.

The photoconductive member 300 as shown in FIG. 3 has the same layer constitution as that of the photoconductive member 100 as shown in FIG. 1 except for having a second amorphous layer (II) 305 on a first amorphous layer (I) 304 which is the same as the amorphous layer 104 as shown in FIG. 1.

That is, the photoconductive member 300 as shown in FIG. 3 is provided with an interface layer 302, a rectifying layer 303, a first amorphous layer (I) 304 having photoconductivity and a second amorphous layer (II) 305, which comprises an amorphous material comprising silicon atoms and carbon atoms, optionaly together with at least one of hydrogen atoms and halogen atoms, as constituent atoms (hereinafter written as "a-SiC(H,X)"), on a support 301 for photoconductive member, the second amorphous layer (II) 305 having a free surface 306.

The second amorphous layer (II) 305 is provided primarily for the purpose of accomplishing the objects of the present invention with respect to humidity resistance, continuous repeated use characteristics, dielectric strength environmental characteristics in use and durability.

In the photoconductive member 300 as shown in FIG. 3, since each of the amorphous materials forming the first amorphous layer (I) 302 and the second amorphous layer (II) 305 have the common constituent of silicon atom, chemical and electric stabilities are sufficiently ensured at the laminated interface.

As a-SiC(H,X) constituting the second amorphous layer (II), there may be mentioned an amorphous material constituted of silicon atoms and carbon atoms (a-$Si_aC_{1-a}$, where $0<a<1$), an amorphous material constituted of silicon atoms, carbon atoms and hydrogen atoms [a-$(Si_bC_{1-b})_cH_{1-c}$, where $0<a, b<1$] and an amorphous material constituted of silicon atoms, carbon atoms, halogen atoms and, if desired, hydrogen atoms [a-$(Si_dC_{1-d})_e(X,H)_{1-e}$, where $0<d, e<1$] as effective materials.

Formation of the second amorphous layer (II) constituted of a-SiC(H,X) may be performed according to the glow discharge method, the sputtering method, the ion implantation method, the ion plating method, the electron beam method, etc. These preparation methods may be suitably selected depending on various factors such as the preparation conditions, the degree of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms and carbon atoms, optionally together with hydrogen atoms or halogen atoms, into the second amorphous layer (II) to be prepared, there may preferably be employed the glow discharge method or the sputtering method.

Further, in the present invention, the second amorphous layer (II) may be formed by using the glow discharge method and the sputtering method in combination in the same device system.

For formation of the second amorphous layer (II) according to the glow discharge method, starting gases for formation of a-SiC(H,X), optionally mixed at a predetermined mixing ratio with diluting gas, may be introduced into a deposition chamber for vacuum deposition in which a support is placed, and the gas introduced is made into a gas plasma by excitation of glow discharging, thereby depositing a-SiC(H,X) of the first amorphous layer (I) which has already been formed on the aforesaid support.

As the starting gases for formation of a-SiC(H,X) to be used in the present invention, it is possible to use most of gaseous substances or gasified gasifiable substances containing at least one of Si, C, H and X as constituent atoms.

In case when a starting gas having Si as constituent atoms as one of Si, C, H and X is employed, there may be employed, for example, a mixture of a starting gas containing Si as constituent atom with a starting gas containing H or X as constituent atom at a desired mixing ratio, or alternatively a mixture of a starting gas containing Si as constituent atoms with a starting gas containing C and H or X also at a desired mixing ratio, or a mixture of a starting gas containing Si as constituent atoms with a gas containing three atoms of Si, C and H or of Si, C and X as constituent atoms.

Alternatively, it is also possible to use a mixture of a starting gas containing Si and H or X as constituent atoms with a starting gas containing C as constituent atom.

In the present invention, the starting gases effectively used for formation of the second amorphous layer (II) may include hydrogenated silicon gases containing Si and H as constituent atoms such as silanes (e.g. $SiH_4$, $Si_2H_6$, $Si_3H_8$, $Si_4H_{10}$, etc.), compounds containing C and H as constituent atoms such as saturated hydrocarbons having 1 to 5 carbon atoms, ethylenic hydrocarbons having 2 to 5 carbon atoms and acetylenic hydrocarbons having 2 to 4 carbon atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$); and the like.

As the starting gas containing Si, C and H as constituent atoms, there may be mentioned alkyl silanes such as $Si(CH_3)_4$, $Si(C_2H_5)_4$ and the like. In addition to these starting gases, it is also possible as a matter of course to use $H_2$ as effective starting gas for introduction of H.

In the present invention, preferable halogen atoms (X) to be contained in the second amorphous layer (II) are F, Cl, Br and I. Particularly, F and Cl are preferred.

Incorporation of hydrogen atoms into the second amorphous layer (II) is convenient from aspect of production cost, because a part of starting gas species can be made common in forming continuous layers together with the first amorphous layer (I).

In the present invention, as the starting gas which can be used effectively for introduction of halogen atoms (X) in formation of the second amorphous layer (II), there may be mentioned gaseous substances under conditions of normal temperature and normal pressure or readily gasifiable substances.

Such starting gases for introduction of halogen atoms may include single halogen substances, hydrogen halides, interhalogen compounds, silicon halides, halo-substituted hydrogenated silicons and the like.

More specifically, there may be mentioned, as single halogen substances, halogenic gases such as of fluorine, chlorine, bromine and iodine; as hydrogen halides, FH, HI, HCl, HBr; as interhalogen compounds, BrF, ClF, $ClF_3$, $ClF_5$, $BrF_5$, $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$; as halo-substituted hydrogenated silicon, $SiH_2F_2$, $SiH_2Cl_2$, $SiHCl_3$, $SiH_3Cl$, $SiH_3Br$, $SiH_2Br_2$, $SiHBr_3$; and so on.

In addition to these materials, there may also be employed halo-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$ and the like, fluorinated sulfur compounds such as $SF_4$, $SF_6$ and the like, halo-containing alkyl silanes such as $SiCl(CH_3)_3$, $SiCl_2(CH_3)_2$, $SiCl_3CH_3$ and the like, as effective materials.

For formation of the second amorphous layer (II) according to the sputtering method, a single crystalline or polycrystalline Si wafer or C wafer or a wafer containing Si and C mixed therein is used as target and subjected to sputtering in an atmosphere of various gases.

For example, when Si wafer is used as target, as starting gas for introducing at least C, which may be diluted with a diluting gas, if desired, is introduced into a deposition chamber for sputter to form a gas plasma therein and effect sputtering of said Si wafer.

Alternatively, Si and C as separate targets or one sheet target of a mixture of Si and C can be used and sputtering is effected in a gas atmosphere containing, if necessary, at least hydrogen atoms or halogen atoms.

As the starting gas for introduction of C or for introduction of H or X, there may be employed those as mentioned in the glow discharge as described above as effective gases also in case of the sputtering method.

In the present invention, as the diluting gas to be used in forming the second amorphous layer (II) by the glow discharge method or the sputtering method, there may be preferably employed so called rare gases such as He, Ne, Ar and the like.

The second amorphous layer (II) in the present invention should be carefully formed so that the required characteristics may be given exactly as desired.

That is, a substance containing as constituent atoms Si, C and, if necessary, H and/or X can take various forms from crystalline to amorphous, electrical properties from conductive through semi-conductive to insulating and photoconductive properties from photoconductive to non-photoconductive depending on the preparation conditions. Therefore, in the present invention, the preparation conditions are strictly selected as desired so that there may be formed a—SiC(H,X) having desired characteristics depending on the purpose.

For example, when the second amorphous layer (II) is to be provided primarily for the purpose of improvement of dielectric strength, a—SiC(H,X) is prepared as an amorphous material having marked electric insulating behaviours under the usage conditions.

Alternatively, when the primary purpose for provision of the second amorphous layer (II) is improvement of continuous repeated use characteristics or environmental characteristics in use the degree of the above electric insulating property may be alleviated to some extent and a—SiC(H,X) may be prepared as an amorphous material having sensitivity to some extent to the light irradiated.

In forming the second amorphous layer (II) comprising a—SiC(H,X) on the surface of the first amorphous layer (I), the support temperature during layer formation is an important factor having influences on the structure and the characteristics of the layer to be formed, and it is desired in the present invention to control severely the support temperature during layer formation so that a—SiC(H,X) having intended characteristics may be prepared as desired.

As the support temperature in forming the second amorphous layer (II) for accomplishing effectively the objects of the present invention, there may be selected suitably the optimum temperature range in conformity with the method for forming the second amorphous layer (II) in carrying out formation of the second amorphous layer (II).

When the second amorphous layer (II) is to be formed of a—$Si_aC_{1-a}$, the support temperature may preferably be 20° to 300° C., more preferably 20° to 250° C.

When the second amorphous layer (II) is to be formed of a—$(Si_bC_{1-b})_cH_{1-c}$ or a—$(Si_dC_{1-d})_e(X,H)_{1-e}$, the support temperature may preferably be 50° to 350° C., more preferably 100° to 250° C.

For formation of the second amorphous layer (II), the glow discharge method or the sputtering method may be advantageously adopted, because severe control of the composition ratio of atoms constituting the layer or control of layer thickness can be conducted with relative ease as compared with other methods. In case when the second amorphous layer (II) is to be formed according to these layer forming methods, the discharging power and the gas pressure during layer formation are important factors influencing the characteristics of a—SiC(H,X) to be prepared, similarly as the aforesaid support temperature.

The discharging power condition for preparing effectively a—$Si_aC_{1-a}$ having characteristics for accomplishing the objects of the present invention with good productivity may preferably be 50 W to 250 W, most preferably 80 W to 150 W.

The discharging power conditions, in case of a—$(Si_bC_{1-b})_cH_{1-c}$ or a—$(Si_dC_{1-d})_e(X,H)_{1-e}$, may preferably be 10 to 300 W, more preferably 20 to 200 W.

The gas pressure in a deposition chamber may preferably be about 0.01 to 5 Torr, more preferably about 0.01 to 1 Torr, most preferably about 0.1 to 0.5 Torr.

In the present invention, the above numerical ranges may be mentioned as preferable numerical ranges for the support temperature, discharging power, etc. for preparation of the second amorphous layer (II). However, these factors for layer formation should not be determined separately independently of each other, but it is desirable that the optimum values of respective layer forming factors should be determined based on mutual organic relationships so that a second amorphous layer (II) comprising a—SiC(H,X) having desired characteristics may be formed.

The contents of carbon atoms and hydrogen atoms in the second amorphous layer (II) in the photoconductive member of the present invention are the second important factor for obtaining the desired characteristics to accomplish the objects of the present invention, similarly as the conditions for preparation of the second amorphous layer (II).

The content of carbon atoms contained in the second amorphous layer in the present invention, when it is constituted of a—$Si_aC_{1-a}$, may be generally $1\times10^{-3}$ to 90 atomic %, preferably 1 to 80 atomic %, most preferably 10 to 75 atomic %. That is, in terms of the aforesaid representation a in the formula a—$Si_aC_{1-a}$, a may be generally 0.1 to 0.99999, preferably 0.2 to 0.99, most preferably 0.25 to 0.9.

When the second amorphous layer (II) is constituted of a—$(Si_bC_{1-b})_cH_{1-c}$, the content of carbon atoms contained in said layer (II) may be generally $1\times10^{-3}$ to 90 atomic %, preferably 1 to 90 atomic %, most preferably 10 to 80 atomic %. The content of hydrogen atoms may be generally 1 to 40 atomic %, preferably 2 to 35 atomic %, most preferably 5 to 30 atomic %. A photoconductive member formed to have a hydrogen atom content with these ranges is sufficiently applicable as an excellent one in practical applications. That is, in terms of the representation by a—$(Si_bC_{1-b})_cH_{1-c}$, b may be generally 0.1 to 0.99999, preferably 0.1 to 0.99, most preferably 0.15 to 0.9, and c generally 0.6 to 0.99, preferably 0.65 to 0.98, most preferably 0.7 to 0.95.

When the second amorphous layer (II) is constituted of a—$(Si_dC_{1-d})_e(X,H)_{1-e}$, the content of carbon atoms contained in said layer (II) may be generally $1\times10^{-3}$ to 90 atomic %, preferably 1 to 90 atomic %, most preferably 10 to 80 atomic %. The content of halogen atoms may be generally 1 to 20 atomic %, preferably 1 to 18 atomic %, most preferably 2 to 15 atomic %. A photoconductive member formed to have a halogen atom content with these ranges is sufficiently applicable as an excellent one in practical applications. The content of hydrogen atoms to be optionally contained may be generally up to 19 atomic %, preferably 13 atomic %. That is, in terms of the representation by a—$(Si_dC_{1-d})_e(X,H)_{1-e}$, d may be generally 0.1 to 0.99999, preferably 0.1 to 0.99, most preferably 0.15 to 0.9, and e generally 0.8 to 0.99, preferably 0.82 to 0.99, most preferably 0.85 to 0.98.

The range of the numerical value of layer thickness of the second amorphous layer (II) in the present invention is one of important factors for accomplishing effectively the objects of the present invention.

It is desirable that the range of the numerical value of layer thickness of the second amorphous layer (II) is suitably determined depending on the intended purpose so as to effectively accomplish the objects of the present invention.

The layer thickness of the second amorphous layer (II) is required to be determined as desired suitably with due considerations about the relationships with the contents of carbon atoms, hydrogen atoms or halogen atoms, the layer thickness of the first amorphous layer (I), as well as other organic relationships with the characteristics required for respective layer regions. In addition, it is also desirable to have considerations from economical point of view such as productivity or capability of mass production.

The second amorphous layer (II) in the present invention is desired to have a layer thickness generally of 0.003 to 30μ, preferably 0.004 to 20μ, most preferably 0.005 to 10μ.

Figure 4:
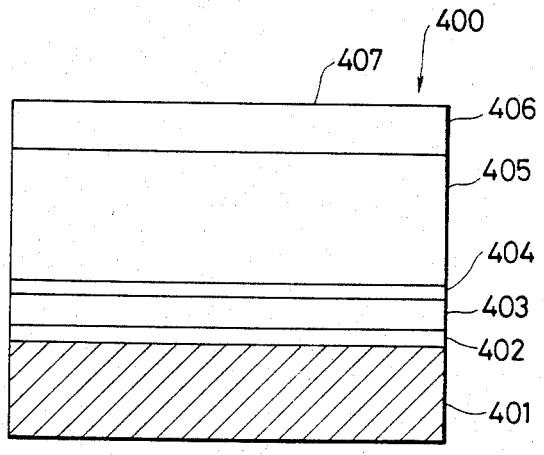

FIG. 4 shows the fourth embodiment of the present invention.

The photoconductive member 400 as shown in FIG. 4 is different from the photoconductive member 200 as shown in FIG. 2 in having a second amorphous layer 406 similar to the second amorphous layer 305 as shown in FIG. 3 on a first amorphous layer 405.

That is, the photoconductive member 400 has a support 401, and, consecutively laminated on said support 401, a lower interface layer 402, a rectifying layer 403, an upper interface layer 404, a first amorphous layer (I) 405 and a second amorphous layer (II) 406, the second amorphous layer (II) 406 having a free surface 407.

The photoconductive member of the present invention designed to have layer constitution as described above can overcome all of the problems as mentioned above and exhibit very excellent electrical, optical, photoconductive characteristics, dielectric strength, as well as good environmental characteristics in use.

In particular, when it is applied as an image forming member for electrophotography, it is free from influence of residual potential on image formation at all, being stable in its electrical properties with high sensitivity and having high SN ratio as well as excellent light fatigue resistance and repeated usage characteristics, whereby it is possible to obtain repeatedly images of high quality with high concentration, clear halftone and high resolution.

Also, the amorphous layer itself formed on the support, in photoconductive member of the present invention, is tough and very excellent in adhesion to the support and therefore it is possible to use the photoconductive member at a high speed repeatedly and continuously for a long time.

Next, a process for producing the photoconductive member formed according to the glow discharge decomposition method is to be described.

Figure 5:
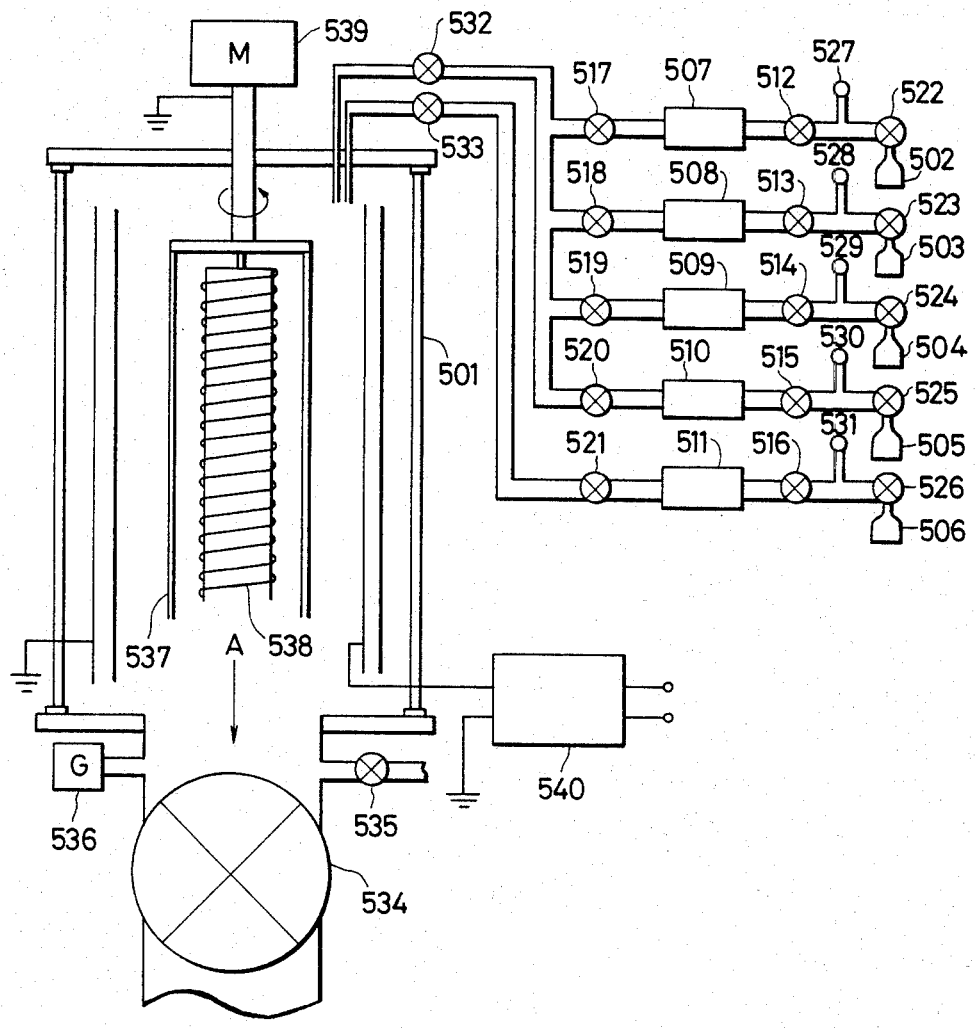
FIG. 5 and FIG. 6 schematic flow charts for illustration of examples of the device used for preparation of the photoconductive members of the present invention, respectively.

FIG. 5 shows a device for producing a photoconductive member according to the glow discharge decomposition method.

In the gas bombs 502 to 506, there are hermetically contained starting gases for formation of respective layers of the present invention. For example, 502 is a bomb containing $SiH_4$ gas (purity: 99.999%) diluted with He (hereinafter abbreviated as "$SiH_4$/He"), 503 is a bomb containing $B_2H_6$ gas (purity: 99.999%) diluted with He (hereinafter abbreviated as "$B_2H_6$/He"), 504 is a bomb containing $NH_3$ gas (purity: 99.9%), 505 is a bomb containing $SiF_4$ gas (purity: 99.999%) diluted with He (hereinafter abbreviated as "$SiF_4$/He") and 506 is a bomb containing $C_2H_4$ gas (purity: 99.999%).

The kinds of gases to be filled in these bombs can of course be changed depending on the kinds of the layers to be formed.

For allowing these gases to flow into the reaction chamber 501, on confirmation of the valves 522–526 of the gas bombs 502–506 and the leak valve 535 to be closed, and the inflow valves 512–516, the outflow valves 517–521 and the auxiliary valves 532, 533 to be opened, the main valve 534 is first opened to evacuate the reaction chamber 501 and the gas pipelines. As the next step, when the reading on the vacuum indicator 536 becomes about $5\times10^{-6}$ Torr, the auxiliary valve 532, 533 and the outflow valves 517–521 are closed.

Then, the valves of the gas pipelines connected to the bombs of gases to be introduced into the reaction chamber are operated as scheduled to introduce desired gases into the reaction chamber 501.

In the following, one example of the procedure in preparation of a photoconductive member having the constitution as shown in FIG. 3 is to be briefly described.

$SiH_4$/He gas from the gas bomb 502 and $NH_3$ gas from the gas bomb 504 are permitted to flow into the mass-flow controllers 507 and 509, respectively, by opening the valves 522 and 524 to control the pressures at the outlet pressure gauges 527 and 529 to 1 kg/cm$^2$, respectively, and opening gradually the inflow valves 512 and 514, respectively. Subsequently, the outflow valves 517 and 519 and the auxiliary valve 532 are gradually opened to permit respective gases to flow into the reaction chamber 501. The opening of outflow valves 526 and 529 are controlled so that the relative flow rate ratio of $SiH_4$/He to $NH_3$ may have a desired value and opening of the main valve 534 is also controlled while watching the reading on the vacuum indicator 536 so that the pressure in the reaction chamber may reach a desired value.

And, after confirming that the temperature of the support 537 is set at 50°–400° C. by the heater 538, the power source 540 is set at a desired power to excite glow discharge in the reaction chamber 501, and this glow discharging is maintained for a desired period of time to prepare an interface layer on the support with a desired thickness on the support.

Preparation of a rectifying layer on an interface layer may be conducted according to, for example, the procedure as described below.

After formation of an interface has been completed, the power source 540 is turned off for intermission of discharging, and the valves in the whole system for pipelines for introduction of gases in the device are once closed to discharge the gases remaining in the reaction chamber 501 out of the reaction chamber 501, thereby evacuating the chamber to a predetermined degree of vacuum. Then, the valves 522 and 523 for $SiH_4$/He gas from the gas bomb 502 and $B_2H_6$/He gas from the gas bomb 503, respectively, were opened to adjust the pressures at the outlet pressure gauges 527 and 528 to 1 kg/cm$^2$, respectively, followed by gradual opening of the inflow valves 512 and 513, respectively, to permit the gases to flow into the mass-flow controllers 507 and 508, respectively. Subsequently, by opening gradually the outflow valves 517, 518 and the auxiliary valve 532, the respective gases are permitted to flow into the reaction chamber 501. The outflow valves 527 and 528 are thereby adjusted so that the ratio of the flow rate of $SiH_4$/He gas to $B_2H_6$/He gas may become a desired value, and opening of the main valve 534 is also adjusted while watching the reading on the vacuum indicator 536 so that the pressure in the reaction chamber may become a desired value. And, after confirming that the temperature of the support 537 is set with the heater 538 within the range from 50° to 400° C., the power from the power source 540 is set at a desired value to excite glow discharging in the reaction chamber 501, which glow discharging is maintained for a predetermined period of time thereby to form a rectifying layer with a desired layer thickness on an interface layer.

Formation of a first amorphous layer (I) may be performed by use of, for example, $SiH_4$/He gas filled in the bomb 502 according to the same procedure as described in the case of the aforesaid interface layer or the rectifying layer. As the starting gas species to be used for formation of a first amorphous layer (I), other than $SiH_4$/He gas, there may be employed particularly effectively $Si_2H_6$/He gas for improvement of layer formation speed.

Formation of a second amorphous layer (II) on a first amorphous layer (I) may be performed by use of, for example, $SiH_4$/He gas filled in the bomb 502 and $C_2H_4$ gas filled in the bomb 506 according to the same procedure as described in the case of the aforesaid interface layer or the rectifying layer.

In case when halogen atoms (X) are to be incorporated in the interface layer, the rectifying layer or the first amorphous layer (I), the gases employed for formation of the above respective layers are further added with, for example, $SiF_4$/He gas and delivered into the reaction chamber 501.

Figure 6:
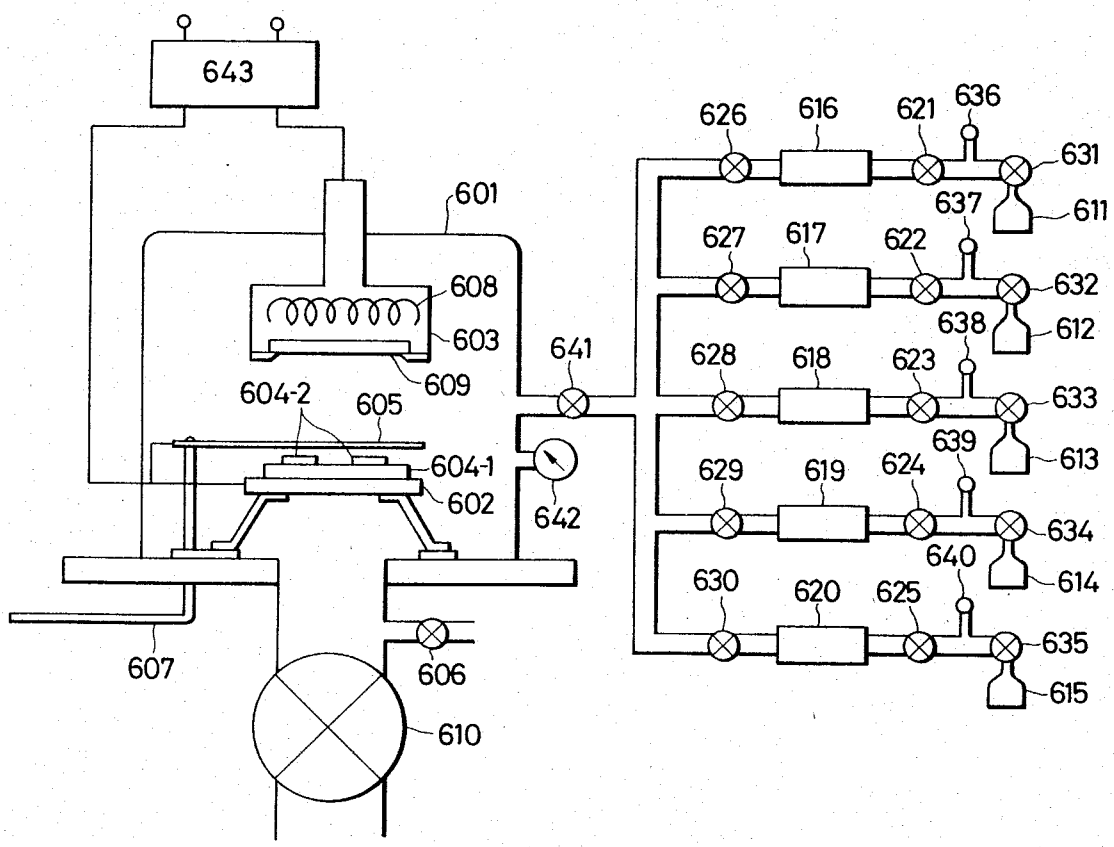

Next, the method for preparation of a photoconductive member by use of a vacuum deposition device as shown in FIG. 6 is to be described. The preparation device shown in FIG. 6 is an example in which the glow discharge decomposition method and the sputtering method can suitably be selected depending on the layers to be formed.

In the gas bombs 611 to 615, there are hermetically contained starting gases for formation of respective layers of the present invention. For example, the bomb 611 is filled with $SiH_4$/He gas, the bomb 612 with $B_2H_6$/He gas, the bomb 613 with $SiF_4$/He, the bomb 614 with $NH_3$ gas and the bomb 615 with Ar gas, respectively. The kinds of gases to be filled in these bombs can of course be changed depending on the kinds of the layers to be formed.

For allowing these gases to flow into the reaction chamber 601, on confirmation of the valves 631–635 of the gas bombs 611–615 and the leak valve 606 to be closed, and the inflow valves 621–625, the outflow valves 626–630 and the auxiliary valve 641 to be opened, the main valve 610 is first opened to evacuate the reaction chamber 601 and the gas pipelines. As the next step, when the reading on the vacuum indicator 642 becomes about $5\times10^{-6}$ Torr, the auxiliary valve 641 and the outflow valves 626 to 630 are closed. Then, the valves of the gas pipelines connected to the bombs of gases to be introduced into the reaction chamber are operated as scheduled to introduce desired gases into the reaction chamber 601.

In the following, one example of the procedure in preparation of a photoconductive member having the constitution as shown in FIG. 3 is to be briefly described.

$SiH_4$/He gas from the gas bomb 611 and $NH_3$ gas from the gas bomb 614 are permitted to flow into the mass-flow controllers 616 and 619, respectively, by opening the valves 631 and 634 to control the pressures at the outlet pressure gauges 636 and 639 to 1 kg/cm$^2$, respectively, and then opening gradually the inflow valves 621 and 624, respectively. Subsequently, the outflow valves 626 and 629 and the auxiliary valve 641 are gradually opened to permit respective gases to flow into the reaction chamber 601. During this operation, the opening of outflow valves 626 and 629 are controlled so that the relative flow rate ratio of $SiH_4$/He to $NH_3$ may become a desired value and opening of the main valve 610 is also controlled while watching the reading on the vacuum indicator 642 so that the pressure in the reaction chamber 601 may reach a desired value.

And, after confirming that the temperature of the support 609 is set at 50°–400° C. by the heater 608, the power source 643 is set at a desired power to excite glow discharge in the reaction chamber 601, and this glow discharging is maintained for a desired period of time to prepare an interface layer on the support with a desired thickness on the support.

Preparation of a rectifying layer on an interface layer may be conducted according to, for example, the procedure as described below.

After formation of an interface has been completed, the power source 643 is turned off for intermission of discharging, and the valves in the whole system for pipelines for introduction of gases in the device are once closed to discharge the gases remaining in the reaction chamber 601 out of the reaction chamber 601, thereby evacuating the chamber to a predetermined degree of vacuum.

Then, the valves 631 and 632 for $SiH_4$/He gas from the gas bomb 611 and $B_2H_6$/He gas from the gas bomb 612, respectively, were opened to adjust the pressures at the outlet pressure gauges 631 and 632 to 1 kg/cm$^2$, respectively, followed by gradual opening of the inflow valves 621 and 622, respectively, to permit the gases to flow into the mass-flow controllers 616 and 617, respectively. Subsequently, by opening gradually the outflow valves 626, 627 and the auxiliary valve 641, the respective gases are permitted to flow into the reaction chamber 601. The outflow valves 626 and 627 are thereby adjusted so that the ratio of the flow rate of $SiH_4$/He gas to $B_2H_6$/He gas may become a desired value, and opening of the main valve 610 is also adjusted while watching the reading on the vacuum indicator 642 so that the pressure in the reaction chamber may become a desired value. And, after confirming that the temperature of the support 609 is set with the heater 608 within the range from 50° to 400° C., the power from the power source 643 is set at a desired value to excite glow discharging in the reaction chamber 601, which glow discharging is maintained for a predetermined period of time thereby to form a rectifying layer with a desired layer thickness on an interface layer.

Formation of a first amorphous layer (I) may be performed by use of, for example, $SiH_4$/He gas filled in the bomb 611 according to the same procedure as described in the case of the aforesaid interface layer or the rectifying layer.

As the starting gas species to be used for formation of a first amorphous layer (I), other than $SiH_4$/He gas, there may be employed particularly effectively $Si_2H_6$/He gas for improvement of layer formation speed.

Formation of a second amorphous layer (II) on a first amorphous layer (I) may be performed by, for example, the following procedure. First, the shutter 605 is opened. All the gas supplying valves are once closed and the reaction chamber 601 is evacuated by full opening of the main valve 610.

On the electrode 602 to which a high voltage power is to be applied, there are previously provided targets having arranged a high purity silicon wafer 604-1 and high purity graphite wafers 604-2 at a desired area ratio. From the gas bomb 615, Ar gas is introduced into the reaction chamber 601, and the main valve 610 is adjusted so that the inner pressure in the reaction chamber 601 may become 0.05 to 1 Torr. The high voltage power source is turned on and the targets are subjected to sputtering at the same time, whereby a second amorphous layer (II) can be formed on a first amorphous layer (I).

In case when halogen atoms (X) are to be incorporated in the interface layer, the rectifying layer or the first amorphous layer (I), the gases employed for formation of the above respective layers are further added with, for example, $SiF_4$/He and delivered into the reaction chamber 601.

EXAMPLE 1

By means of the preparation device as shown in FIG. 5, layers were formed on a drum-shaped aluminum substrate under the following conditions.

TABLE 1

| Order of layer formation | Conditions | | | | |
|---|---|---|---|---|---|
| | Gases employed | Flow rate (SCCM) | Flow rate ratio | Discharging power (W/cm$^2$) | Layer thickness |
| 1 (Interface layer) | $SiH_4$/He = 1<br>$NH_3$ | $SiH_4$ = 10 | $SiH_4$:$NH_3$ = 1:30 | 0.18 | 500Å |
| 2 (Rectifying layer) | $SiH_4$/He = 1<br>$B_2H_6$/He = $10^{-2}$ | $SiH_4$ = 200 | $SiH_4$:$B_2H_6$ = 1:1.6 × $10^{-3}$ | 0.18 | 2000Å |
| 3 | $SiH_4$/He = 1 | $SiH_4$ = 200 | | 0.18 | 15μ |

TABLE 1-continued

| Order of layer formation | Conditions | | | | |
|---|---|---|---|---|---|
| | Gases employed | Flow rate (SCCM) | Flow rate ratio | Discharging power ($W/cm^2$) | Layer thickness |
| (Amorphous layer) | | | | | |

Aluminum substrate temperature: 250° C.
Discharging frequency: 13.56 MHz
Inner pressure in reaction chamber: 0.3 Torr The image forming member for electrophotography thus obtained was set in a copying device, subjected to corona charging at ⊕5 KV for 0.2 sec. and irradiated with a light image. As the light source, a tungsten lamp was employed at a dose of 1.0 lux.sec. The latent image was developed with a negatively charged developer (containing toner and carrier) and transferred onto a plain paper. The transferred image was found to be very good. The toner remaining on the photosensitive drum without being transferred was subjected to cleaning by a rubber blade before turning to the next cycle of copying. Such a step was repeated for 100,000 times or more, whereby no peel-off of layers occurred and the images obtained were good.

EXAMPLE 2

Figure 7:
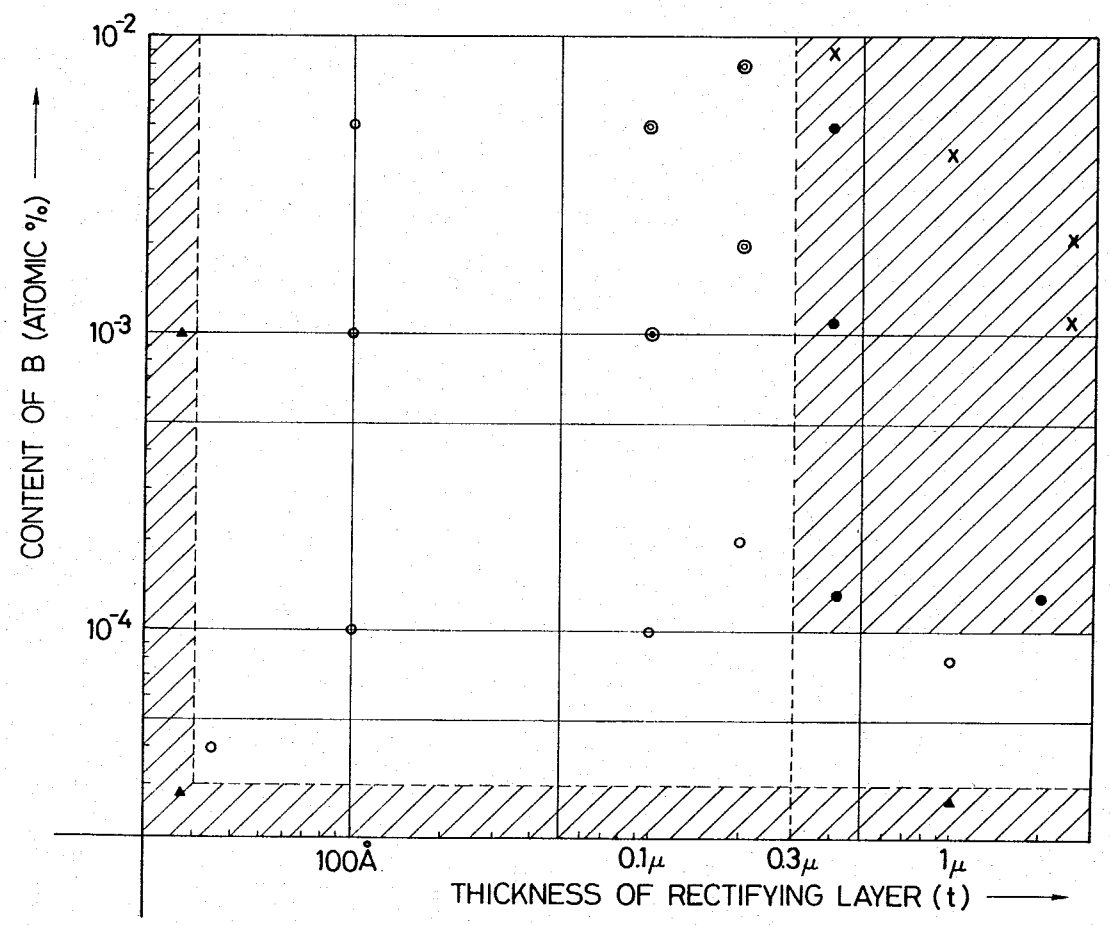
FIG. 7 and FIG. 8 show diagrams indicating the results obtained in Examples.

Layer forming operations were conducted according to the same procedure as in Example 1 except for varying the layer thickness of the rectifying layer and the content of boron. The results are shown in FIG. 7. Evaluations were performed according to the following standards of rating:

◎: excellent film strength, very good image quality and very good durability in repeated uses;

○: excellent film strength, good image quality and good durability in repeated uses;

▲: slightly good film peel-off resistance, but defective in practical image quality (density);

●: peel-off of layers sometimes occur, but no problem in practical application;

X: peel-off of layers sometimes occur, but not so defective in image quality.

EXAMPLE 3

Electrophotographic photosensitive drums were prepared according to entirely the same procedure as in Example 1 except for varying the conditions for forming the interface layer as follows. Evaluations of these drums in a similar manner as described in Example 1 gave good results of both film strength and image characteristics.

TABLE 2

| Sample No. | Conditions | |
|---|---|---|
| | $SiH_4$:$NH_3$ (Flow rate ratio) | Layer thickness (Å) |
| 31 | 7:3 | 1000 |
| 32 | 1:1 | 500 |
| 33 | 1:3 | 300 |
| 34 | 1:50 | 200 |

EXAMPLE 4

By means of the preparation device as shown in FIG. 5, layers were formed on a drum-shaped aluminum substrate under the following conditions.

TABLE 3

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Lower interface layer) | $SiH_4$/He = 1<br>$NH_3$ | $SiH_4$ = 10 | $SiH_4$:$NH_3$ = 1:30 | 0.18 | 500Å |
| 2 (Rectifying layer) | $SiH_4$/He = 1<br>$B_2H_6$/He = $10^{-2}$ | $SiH_4$ = 200 | $SiH_4$:$B_2H_6$ = 1:3.0 × $10^{-3}$ | 0.18 | 2000Å |
| 3 (Upper interface layer) | $SiH_4$/He = 1 | $SiH_4$ = 10 | $SiH_4$:$NH_3$ = 1:10 | 0.18 | 500Å |
| 4 (Amorphous layer) | $SiH_4$/He = 1 | $SiH_4$ = 200 | | 0.18 | 15μ |

The thus obtained electrophotographic photosensitive drum was evaluated similarly as in Example 1 to obtain very good results of both layer strength and image characteristics.

EXAMPLE 5

By means of the preparation device as shown in FIG. 5, layers were formed on a drum-shaped aluminum substrate under the following conditions.

TABLE 4

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4$/He = 1<br>$SiF_4$/He = 1<br>$NH_3$ | $SiH_4$ = 10 | $SiH_4$:$SiF_4$:$NH_3$ = 1:1:30<br>1:1:30 | 0.18 | 400Å |
| 2 (Rectifying layer) | $SiH_4$/He = 1<br>$SiF_4$/He = 1<br>$B_2H_6$/He = $10^{-2}$ | $SiH_4$ = 100 | $SiH_4$:$SiF_4$:$B_2H_6$ = 1:1:1 × $10^{-3}$ | 0.18 | 1000Å |
| 3 (Amorphous layer) | $SiH_4$/He = 1<br>$SiF_4$/He = 1 | $SiH_4$ = 100 | $SiH_4$:$SiF_4$ = 1:1 | 0.18 | 15μ |

The thus obtained electrophotographic photosensitive drum was evaluated similarly as in Example 1 to obtain very good results of both layer strength and image characteristics.

EXAMPLE 6

By means of the preparation device as shown in FIG. 6, layers were formed on an aluminum substrate under the following conditions.

TABLE 5

| Order of layer formation | Conditions | | | | |
|---|---|---|---|---|---|
| | Gases employed | Flow rate (SCCM) | Flow rate ratio (or area ratio) | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:1.6 \times 10^{-3}$ | 0.18 | 2000Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite = 1.5:8.5 | 0.3 | 0.5μ |

Aluminum substrate temperature: 250° C.
Discharging frequency: 13.56 MHz
Inner pressure in reaction chamber:
0.3 Torr during formation of amorphous layer (I)
0.2 Torr during formation of amorphous layer (II)

The image forming member thus obtained was set in a charging-exposure-developing device, subjected to corona charging at ⊕5 KV for 0.2 sec. followed immediately by irradiation of a light image. As the light source, a tungsten lamp was employed and irradiation was effected at a dose of 1.0 lux.sec. using a transmissive type test chart.

Immediately thereafter, a negatively charged developer (containing toner and carrier) was cascaded onto the surface of the member, whereby a good toner image was obtained thereon.

The thus obtained toner image was once subjected to cleaning with a rubber blade and again the above image preparation-cleaning steps were repeated. No deterioration of image was observed even after a repetition number of 150,000 or more.

EXAMPLE 7

By means of the preparation device as shown in FIG. 6, layers were formed on an aluminum substrate under the following conditions.

TABLE 6

| Order of layer formation | Conditions | | | | |
|---|---|---|---|---|---|
| | Gases employed | Flow rate (SCCM) | Flow rate ratio (or area ratio) | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 300Å |
| 2 (Rectifying layer) | $SiH_4/He = 1$ $B_2H_6/He = 10^{-2}$ | $SiH_4 = 200$ | $SiH_4:B_2H_6 = 1:4.0 \times 10^{-3}$ | 0.18 | 1000Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite 0.5:9.5 | 0.3 | 0.3μ |

Other conditions were the same as in Example 6.

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image preparation-cleaning steps were repeated. No deterioration of image was observed even after a repetition number of 100,000 or more.

EXAMPLE 8

By means of the preparation device as shown in FIG. 6, layers were formed on an aluminum substrate under the following conditions.

TABLE 7

| Order of layer formation | Conditions | | | | |
|---|---|---|---|---|---|
| | Gases employed | Flow rate (SCCM) | Flow rate ratio (or area ratio) | Discharging power ($W/cm^2$) | Layer thickness |
| 1 (Interface layer) | $SiH_4/He = 1$ $NH_3$ | $SiH_4 = 10$ | $SiH_4:NH_3 = 1:3$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:5.0 \times 10^{-4}$ | 0.18 | 2500Å |
| 3 (Amorphous layer (I)) | $SiH_4/He = 1$ | $SiH_4 = 200$ | | 0.18 | 15μ |
| 4 (Amorphous layer (II)) | Ar | 200 | Si Wafer:graphite 6:4 | 0.3 | 1.0μ |

Other conditions were the same as in Example 6.

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

EXAMPLE 9

An image forming member was prepared according to entirely the same procedure as in Example 8 except for charging the methods for forming the interface layer, the rectifying layer and the amorphous layer (I) as shown in Table 8, and changing the content ratio of silicon atoms to carbon atoms in the second amorphous layer (II) by charging the area ratio of silicon wafer to graphite during formation of the amorphous layer (II). For the thus obtained image forming member, image evaluation was conducted after repeating for about 50,000 times the steps of image making, developing and cleaning in a similar manner as described in Example 6 to obtain the results as shown in Table 9.

TABLE 8

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:1$ | 0.18 | 700Å |
| 2 (Rectifying layer) | $SiH_4/He = 1$ $B_2H_6/He = 10^{-2}$ | $SiH_4 = 200$ | $SiH_4:B_2H_6 = 1:3.0 \times 10^{-3}$ | 0.18 | 1500Å |
| 3 (Amorphous layer (I)) | $SiH_4/He = 1$ | $SiH_4 = 200$ | | 0.18 | 15μ |

TABLE 9

| Si:C target (area ratio) | 9:1 | 6.5:3.5 | 4:6 | 2:8 | 1:9 | 0.5:9.5 | 0.2:9.8 |
|---|---|---|---|---|---|---|---|
| Si:C (content ratio) | 9.7:0.3 | 8.8:1.2 | 7.3:2.7 | 4.8:5.2 | 3:7 | 2:8 | 0.8:9.2 |
| Image quality | Δ | ○ | ◎ | ◎ | ◎ | ○ | X |

TABLE 9-continued evaluation

◎: Very good
○: Good
Δ: Practically useful
X: Liable to form image defect

EXAMPLE 10

Image forming members were prepared according to entirely the same procedure as in Example 6 except for varying the layer thickness of the amorphous layer (II). By repeating the image making, developing and cleaning steps as described in Example 6, the following results were obtained.

TABLE 10

| Thickness of amorphous layer (II) (μ) | Results |
|---|---|
| 0.001 | Image defect liable to occur |
| 0.02 | Substantially no image defect after 20,000 repetitions |
| 0.05 | Stable after 50,000 repetitions or more |
| 1 | Stable after 200,000 repetitions or more |

EXAMPLE 11

An image forming member was prepared according to the same procedure as in Example 6 except for changing the methods for forming the layers other than the amorphous layer (II) to those as shown in the Table below, and evaluation was conducted similarly as in Example 6 to obtain good results.

TABLE 11

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:3.0 \times 10^{-3}$ | 0.18 | 2000Å |
| 3 (Interface layer) | $SiH_4/He = 1$ $NH_3$ | $SiH_4 = 10$ | $SiH_4:NH_3 = 1:10$ | 0.18 | 500Å |
| 4 (Amorphous layer (I)) | $SiH_4/He = 1$ | $SiH_4 = 200$ | | 0.18 | 15μ |

EXAMPLE 12

An image forming member was prepared according to the same procedure as in Example 6 except for changing the methods for forming the layers other than the amorphous layer (II) to those as shown in the Table below, and evaluation was conducted similarly as in Example 6 to obtain good results.

TABLE 12

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$SiF_4/He = 1$<br>$NH_3$ | $SiH_4 = 10$ | $SiH_4:SiF_4:NH_3 = 1:1:30$ | 0.18 | 400Å |
| 2 (Rectifying layer) | $SiH_4/He = 1$<br>$SiF_4/He = 1$<br>$B_2H_6/He = 10^{-2}$ | $SiH_4 = 100$ | $SiH_4:SiF_4:B_2H_6 = 1:1:1 \times 10^{-3}$ | 0.18 | 1000Å |
| 3 (Amorphous layer (I)) | $SiH_4/He = 1$<br>$SiF_4/He = 1$ | $SiH_4 = 100$ | $SiH_4:SiF_4 = 1:1$ | 0.18 | 15μ |

EXAMPLE 13

By means of the preparation device as shown in FIG. 5, layers were formed on a drum-shaped aluminum substrate under the following conditions.

TABLE 13

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 500Å |
| 2 (Rectifying layer) | $SiH_4/He = 1$<br>$B_2H_6/He = 10^{-2}$ | $SiH_4 = 200$ | $SiH_4:B_2H_6 = 1:1.6 \times 10^{-3}$ | 0.18 | 2000Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$<br>$C_2H_4$ | $SiH_4 = 100$ | $SiH_4:C_2H_4 = 3:7$ | 0.18 | 0.5μ |

Aluminum substrate temperature: 250° C.
Discharging frequency: 13.56 MHz
Inner pressure in reaction chamber:
0.3 Torr during formation of Layer (I)
0.5 Torr during formation of Layer (II)

The photosensitive drum (image forming member for electrophotography) thus obtained was set in a copying device, subjected to corona charging at ⊕5 KV for 0.2 sec. and irradiated with a light image. As the light source, a tungsten lamp was employed at a dose of 1.0 lux.sec. The latent image was developed with a negatively charged developer (containing toner and carrier) and transferred onto a plain paper. The transferred image was found to be very good. The toner remaining on the photosensitive drum without being transferred was subjected to cleaning by a rubber blade before turning to the next cycle of copying. Such a step was repeated for 150,000 times or more, whereby no peel-off of layers occurred and the images obtained were good.

EXAMPLE 14

Layers were formed on a drum-shaped aluminum substrate by means of the preparation device as shown in FIG. 5 under the conditions as shown below.

TABLE 14

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 300Å |
| 2 (Rectifying layer) | $SiH_4/He = 1$<br>$B_2H_6/He = 10^{-2}$ | $SiH_4 = 200$ | $SiH_4:B_2H_6 = 1:4.0 \times 10^{-3}$ | 0.18 | 1000Å |
| 3 (Amorphous layer (I)) | $SiH_4/He = 1$ | $SiH_4 = 200$ | | 0.18 | 15μ |
| 4 (Amorphous layer (II)) | $SiH_4/He = 1$<br>$C_2H_4$ | $SiH_4 = 15$ | $SiH_4:C_2H_4 = 0.4:9.6$ | 0.18 | 0.3μ |

Other conditions were the same as in Example 13.

The photosensitive drum thus obtained was set in a copying device, subjected to corona charging at ⊕5 KV for 0.2 sec. and irradiated with a light image. As the light source, a tungsten lamp was employed at a dose of 1.0 lux.sec. The latent image was developed with a negatively charged developer (containing toner and carrier) and transferred onto a plain paper. The transferred image was found to be very good. The toner remaining on the photosensitive drum without being transferred was subjected to cleaning by a rubber blade before turning to the next cycle of copying. Such a step was repeated for 100,000 times or more, whereby no deterioration of image was observed.

EXAMPLE 15

Layers were formed on a drum-shaped aluminum substrate by means of the preparation device as shown in FIG. 5 under the conditions shown below.

TABLE 15

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 | $SiH_4/He = 1$ | $SiH_4 = 10$ | $SiH_4:NH_3 = 1:3$ | 0.18 | 500Å |

TABLE 15-continued

| Order of layer formation | Conditions | | | | |
|---|---|---|---|---|---|
| | Gases employed | Flow rate (SCCM) | Flow rate ratio | Discharging power ($W/cm^2$) | Layer thickness |
| (Interface layer) | $NH_3$ | | | | |
| 2 (Rectifying layer) | $SiH_4/He = 1$ $B_2H_6/He = 10^{-2}$ | $SiH_4 = 200$ | $SiH_4:B_2H_6 = 1:5.0 \times 10^{-4}$ | 0.18 | 2500Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $C_2H_4$ | $SiH_4 = 100$ | $SiH_4:C_2H_4 = 5:5$ | 0.18 | 1.5μ |

Other conditions were the same as in Example 13.

The photosensitive drum thus obtained was set in a copying device, subjected to corona charging at ⊕5 KV for 0.2 sec. and irradiated with a light image. As the light source, a tungsten lamp was employed at a dose of 1.0 lux.sec. The latent image was developed with a negatively charged developer (containing toner and carrier) and transferred onto a plain paper. The transferred image was found to be very good with high density. The toner remaining on the photosensitive drum without being transferred was subjected to cleaning by a rubber blade before turning to the next cycle of copying. Such a step was repeated for 150,000 times or more, whereby no deterioration of image was observed.

EXAMPLE 16

Layer forming operations were conducted according to entirely the same procedure as in Example 13 except for changing the methods for forming the other layers other than the amorphous layer (II) as shown in Table 16, and changing the content ratio of silicon atoms to carbon atoms in the second amorphous layer (II) by changing the flow rate ratio of $SiH_4$ gas and $C_2H_4$ gas during formation of the amorphous layer (II). For the thus obtained photosensitive drum, image evaluation was conducted after repeating for about 50,000 times the steps of image making, developing and cleaning as described in Example 13 to obtain the results as shown in Table 17.

TABLE 17-continued

| | | | | | | | | |
|---|---|---|---|---|---|---|---|---|
| Image quality evaluation | Δ | ◎ | ◎ | ◎ | ◎ | ◎ | ○ | X |

◎: Very good
○: Good
Δ: Practically satisfactory
X: Slightly liable to form image defect

EXAMPLE 17

Layer forming operations were conducted according to entirely the same procedure as in Example 13 except for varying the film thickness of the amorphous layer (II) as shown in the following Table. The results of evaluation are as shown in the following Table.

TABLE 18

| Thickness of amorphous layer (II) (μ) | Results |
|---|---|
| 0.001 | Image defect liable to occur |
| 0.02 | Substantially no image defect after 20,000 repetitions |
| 0.05 | Substantially no image defect after 50,000 repetitions |
| 2 | Stable after 200,000 repetitions or more |

EXAMPLE 18

TABLE 16

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:1$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:3.0 \times 10^{-3}$ | 0.18 | 1500Å |
| 3 (Amorphous layer (I)) | $SiH_4/He = 1$ | $SiH_4 = 200$ | | 0.18 | 15μ |

TABLE 17

| | | | | | | | | |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |

Layer forming operations were conducted according to the same procedure as in Example 13 except for changing the methods for forming the layers other than the amorphous layer (II) to those as shown in the Table below, and evaluation was conducted similarly as in Example 13 to obtain good results.

TABLE 19

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:3.0 \times 10^{-3}$ | 0.18 | 2000Å |
| 3 | $SiH_4/He = 1$ | $SiH_4 = 10$ | $SiH_4:NH_3 = 1:10$ | 0.18 | 500Å |

TABLE 19-continued

| Order of layer formation | Conditions | | | | |
|---|---|---|---|---|---|
| | Gases employed | Flow rate (SCCM) | Flow rate ratio | Discharging power ($W/cm^2$) | Layer thickness |
| (Interface layer) | $NH_3$ | | | | |
| 4 (Amorphous layer (I) | $SiH_4/He = 1$ | $SiH_4 = 200$ | | 0.18 | 15μ |

EXAMPLE 19

Layer forming operations were conducted according to the same procedures as in Example 13 except for changing the methods for forming the layers other than the amorphous layer (II) to those as shown in the Table below, and evaluation was conducted similarly as in Example 13 to obtain good results.

TABLE 20

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$SiF_4/He = 1$<br>$NH_3$ | $SiH_4 = 10$ | $SiH_4:SiF_4:NH_3 = 1:1:30$ | 0.18 | 400Å |
| 2 (Rectifying layer) | $SiH_4/He = 1$<br>$SiF_4/He = 1$<br>$B_2H_6/He = 10^{-2}$ | $SiH_4 = 100$ | $SiH_4:SiF_4:B_2H_6 = 1:1:1 \times 10^{-3}$ | 0.18 | 1000Å |
| 3 (Amorphous layer (I)) | $SiH_4/He = 1$<br>$SiF_4/He = 1$ | $SiH_4 = 100$ | $SiH_4:SiF_4 = 1:1$ | 0.18 | 15μ |

EXAMPLE 20

By means of the preparation device as shown in FIG. 5, layers were formed on an aluminum substrate under the following conditions.

TABLE 21

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 500Å |
| 2 (Rectifying layer) | $SiH_4/He = 1$<br>$B_2H_6/He = 10^{-2}$ | $SiH_4 = 200$ | $SiH_4:B_2H_6 = 1:1.6 \times 10^{-3}$ | 0.18 | 2000Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$<br>$C_2H_4$ | $SiH_4 + SiF_4 = 150$ | $SiH_4:SiF_4:C_2H_4 = 1.5:1.5:7$ | 0.18 | 0.5μ |

Aluminum substrate temperature: 250° C.
Discharging frequency: 13.56 MHz
Inner pressure in reaction chamber:
0.3 Torr during formation of amorphous layer (I)
0.5 Torr during formation of amorphous layer (II)

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image preparation-cleaning steps were repeated. No deterioration of image was observed even after a repetition number of 150,000 or more.

EXAMPLE 21

By means of the preparation device as shown in FIG. 5, layers were formed on an aluminum substrate under the following conditions.

TABLE 22

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 300Å |
| 2 (Rectifying layer) | $SiH_4/He = 1$<br>$B_2H_6/He = 10^{-2}$ | $SiH_4 = 200$ | $SiH_4:B_2H_6 = 1:4.0 \times 10^{-3}$ | 0.18 | 1000Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$<br>$SiF_4He = 0.5$<br>$C_2H_4$ | $SiH_4 + SiF_4 = 15$ | $SiH_4:SiF_4:C_2H_4 = 0.3:0.1:9.6$ | 0.18 | 0.3μ |

Other conditions were the same as in Example 20.

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image preparation-cleaning steps were repeated. No deterioration of image was observed even after a repetition number of 100,000 or more.

EXAMPLE 22

By means of the preparation device as shown in FIG. 5, layers were formed on an aluminum substrate under the following conditions.

TABLE 23

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:3$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:5.0 \times 10^{-4}$ | 0.18 | 2500Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4He = 0.5$ $C_2H_4$ | $SiH_4 + SiF_4 = 150$ | $SiH_4:SiF_4:C_2H_4 = 3:3:4$ | 0.18 | 1.5μ |

TABLE 24

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:1.6 \times 10^{-3}$ | 0.18 | 2000Å |
| 3 (Amorphous layer (I)) | $SiH_4/He = 1$ | $SiH_4 = 200$ | | 0.18 | 15μ |

TABLE 25

| $SiH_4SiF_2:C_2H_4$ | 5:4:1 | 3:3.5:3.5 | 2:2:6 | 1:1:8 | 0.6:0.4:9 | 0.2:0.3 | 0.2:0.15:9.65 | 0.1:0.1:9.8 |
|---|---|---|---|---|---|---|---|---|
| Si:C (content rate) | 9:1 | 7:3 | 5.5:4.5 | 4:6 | 3:7 | 2:8 | 1.2:8.8 | 0.8:9.2 |
| Image quality evaluation | Δ | ◎ | ◎ | ◎ | ◎ | ◎ | ○ | × |

◎: Very good
○: Good
Δ: Practically satisfactory
×: Slightly liable to form image defect Other conditions were the same as in Example 20.

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a negatively charged developer (containing toner and carrier) was cascaded onto the surface of the image forming member, whereby a good toner image with very high density was obtained thereon.

The thus obtained toner image was once subjected to cleaning with a rubber blade and again the above image preparation-cleaning steps were repeated. No deterioration of image was observed even after a repetition number of 150,000 or more.

EXAMPLE 23

An image forming member was prepared according to entirely the same procedure as in Example 20 except for changing the methods for forming the interface layer, the rectifying layer and the amorphous layer (I) as shown in Table 24, and changing the content ratio of silicon atoms to carbon atoms in the second amorphous layer (II) by changing the flow rate ratio of $SiH_4$, $SiF_4$ and $C_2H_4$ gases during formation of the amorphous layer (II). For the thus obtained image forming member, image evaluation was conducted after repeating for about 50,000 times the steps of image making, developing and cleaning as in Example 20 to obtain the results as shown in Table 25.

EXAMPLE 24

Image forming members were prepared according to entirely the same procedure as in Example 20 except for varying the layer thickness of the amorphous layer (II). By repeating the image making, developing and cleaning steps as described in Example 20, the following results were obtained.

TABLE 26

| Thickness of amorphous layer (II) (μ) | Results |
|---|---|
| 0.001 | Image defect liable to occur |
| 0.02 | Substantially no image defect after 20,000 repetitions |
| 0.05 | Stable after 50,000 repetitions or more |
| 1 | Stable after 200,000 repetitions or more |

EXAMPLE 25

An image forming member was prepared according to the same procedure as in Example 20 except for changing the methods for forming the layers other than the amorphous layer (II) to those as shown in the Table below, and evaluation was conducted similarly as in Example 20 to obtain good results.

TABLE 27

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $B_2H_6$ | $SiH_4 = 200$ | $SiH_4:B_2H_6 = 1:3.0 \times 10^{-3}$ | 0.18 | 2000Å |
| 3 (Interface layer) | $SiH_4/He = 1$ $NH_3$ | $SiH_4 = 100$ | $SiH_4:NH_3 = 1:10$ | 0.18 | 500Å |
| 4 (Amorphous layer (I)) | $SiH_4/He = 1$ | $SiH_4 = 200$ | | 0.18 | 1.5μ |

EXAMPLE 26

An image forming member was prepared according to the same procedure as in Example 20 except for changing the methods for forming the layers other than the amorphous layer (II) to those as shown in the Table below, and evaluation was conducted similarly as in Example 20 to obtain good results.

TABLE 28

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $SiF_4He = 1$ $NH_3$ | $SiH_4 = 10$ | $SiH_4:SiF_4:NH_3 = 1:1:30$ | 0.18 | 400Å |
| 2 (Rectifying layer) | $SiH_4/He = 1$ $SiF_4/He = 1$ $B_2H_6/He = 10^{-2}$ | $SiH_4 = 100$ | $SiH_4:SiF_4:B_2H_6 = 1:1:1 \times 10^{-3}$ | 0.18 | 1000Å |
| 3 (Amorphous layer (I)) | $SiH_4/He = 1$ $SiF_4He = 1$ | $SiH_4 = 100$ | $SiH_4:SiF_4 = 1:1$ | 0.18 | 15μ |

EXAMPLE 27

An image forming member was prepared according to the same procedure as in Example 22 except that the amorphous layer (II) was prepared according to the sputtering method under the conditions as shown below, and evaluated similarly as in Example 22 to obtain good results.

TABLE 29

| | Gases employed | Flow rate (SCCM) | Area ratio of target Si wafer:graphite | Discharging power ($W/cm^2$) | Layer thickness (μ) |
|---|---|---|---|---|---|
| Amorphous layer (II) | Ar $SiF_4/He = 0.5$ | Ar 200 $SiF_4$ 100 | 2.5:7.5 | 0.3 | 1 |

EXAMPLE 28

By means of the preparation device as shown in FIG. 5, layers were formed on a drum-shaped aluminum substrate under the conditions listed in the following Table.

The image forming member for electrophotography thus obtained was set in a copying device, subjected to corona charging at −5 KV for 0.2 sec. and irradiated with a light image. As the light source, a tungsten lamp was employed at a dose of 1.0 lux.sec. The latent image was developed with a positively charged developer (containing toner and carrier) and transferred onto a plain paper. The transferred image was found to be very good. The toner remaining on the light-sensitive drum without being transferred was subjected to cleaning by a rubber blade before turning to the next cycle of copying. Such a step was repeated for 100,000 times or more, whereby no peel-off of layers occurred and the images obtained were good.

TABLE 30

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 | $SiH_4/He = 1$ | $SiH_4 = 200$ | $SiH_4:PH_3 = 1:1.0 \times 10^{-3}$ | 0.18 | 2000Å |

TABLE 30-continued

| Order of layer formation | Conditions | | | | |
|---|---|---|---|---|---|
| | Gases employed | Flow rate (SCCM) | Flow rate ratio | Discharging power ($W/cm^2$) | Layer thickness |
| (Rectifying layer) | $PH_3/He = 10^{-2}$ | | | | |
| 3 | $SiH_4/He = 1$ | $SiH_4 = 200$ | | 0.18 | 15μ |
| (Amorphous layer (I)) | | | | | |

Al substrate temperature: 250° C.
Discharging frequency: 13.56 MHz
Inner pressure in reaction chamber: 0.3 Torr

EXAMPLE 29

Figure 8:
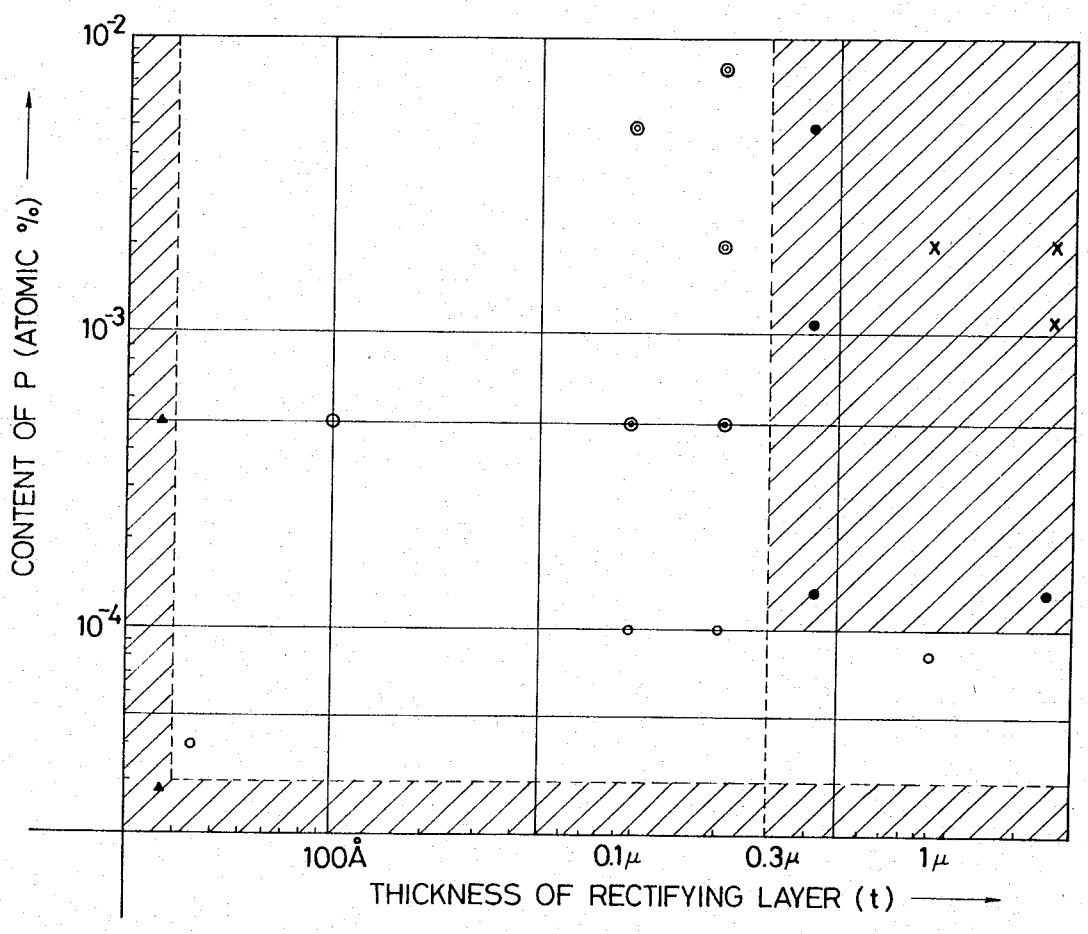

Layer forming operations were conducted according to the same procedure as in Example 28 except for varying the layer thickness of the rectifying layer and the content of phosphorus. The results are shown in FIG. 8. Evaluations were performed according to the following standards of rating:

◎ : excellent film strength, very good image quality and very good durability in repeated uses;

○: excellent film strength, good image quality and good durability in repeated uses;

▲ : slightly good film peel-off resistance, but defective in practical image quality (density);

● : peel-off of layers sometimes occur, but no problem in practical application;

X: peel-off of layers sometimes occur, but not so defective in image quality.

TABLE 31

| Conditions Sample No. | $SiH_4:NH_3$ (Flow rate ratio) | Layer thickness (Å) |
|---|---|---|
| 311 | 7:3 | 1000 |

TABLE 31-continued

| Conditions Sample No. | $SiH_4:NH_3$ (Flow rate ratio) | Layer thickness (Å) |
|---|---|---|
| 312 | 1:1 | 500 |
| 313 | 1:3 | 300 |
| 314 | 1:50 | 200 |

EXAMPLE 31

By means of the preparation device as shown in FIG. 6, layers were formed on a drum-shaped aluminum substrate under the following conditions.

The thus obtained electrophotographic photosensitive drum was evaluated similarly as in Example 28 to obtain very good results of both layer strength and image characteristics.

TABLE 32

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Lower interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $PH_3/He = 10^{-2}$ | $SiH_4 = 200$ | $SiH_4:PH_3 = 1:2.0 \times 10^{-3}$ | 0.18 | 2000Å |
| 3 (Upper interface layer) | $SiH_4/He = 1$ $NH_3$ | $SiH_4 = 10$ | $SiH_4:NH_3 = 1:10$ | 0.18 | 500Å |
| 4 (Amorphous layer (I)) | $SiH_4/He = 1$ | $SiH_4 = 200$ | | 0.18 | 15μ |

EXAMPLE 30

Electrophotographic photosensitive drums were prepared according to entirely the same procedure as in Example 28 except for varying the conditions for forming the interface layer as shown in Table 31. Evaluations of these drums conducted similarly as in Example 28 have good results of both layer strength and image characteristics.

EXAMPLE 32

By means of the preparation device as shown in FIG. 6, layers were formed on a drum-shaped aluminum substrate under the following conditions.

The thus obtained electrophotographic photosensitive drum was evaluated similarly as in Example 28 to obtain very good results of both layer strength and image characteristics.

TABLE 33

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $SiF_4He = 1$ $NH_3$ | $SiH_4 = 10$ | $SiH_4:SiF_4:NH_3 = 1:1:30$ | 0.18 | 400Å |
| 2 (Rectifying layer) | $SiH_4/He = 1$ $SiF_4/He = 1$ $PH_3/He = 10^{-2}$ | $SiH_4 = 100$ | $SiH_4:SiF_4:PH_3 = 1:1:3 \times 10^{-3}$ | 0.18 | 1000Å |
| 3 (Amorphous layer (I)) | $SiH_4/He = 1$ $SiF_4He = 1$ | $SiH_4 = 100$ | $SiH_4:SiF_4 = 1:1$ | 0.18 | 15μ |

EXAMPLE 33

According to the same conditions and the procedures in Examples 28, 31 and 32, respectively, except that the amorphous layers were formed under the conditions shown in the following Table, image forming members were prepared and evaluated similarly as in respective Examples to obtain good results.

TABLE 34

| Layer formed | Gases employed | Flow rate (SCCM) | Flow rate ratio | Discharging power ($W/cm^2$) | Layer thickness ($\mu$) |
|---|---|---|---|---|---|
| Amorphous layer | $SiH_4/He = 1$ | $SiH_4 = 200$<br>$B_2H_6/He = 10^{-2}$ | $SiH_4:B_2H_6 = 1:2 \times 10^{-5}$ | 0.18 | 15 |

EXAMPLE 34

By means of the preparation device as shown in FIG. 6, layers were formed on an aluminum substrate under the conditions listed in the following Table.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image preparation-cleaning steps were repeated. No deterioration of image was observed even after a repetition number of 150,000 or more.

TABLE 35

| Order of layer formation | Conditions | | | | |
|---|---|---|---|---|---|
| | Gases employed | Flow rate (SCCM) | Flow rate ratio (or area ratio) | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 500Å |
| 2 (Rectifying layer) | $SiH_4/He = 1$<br>$PH_3/He = 10^{-2}$ | $SiH_4 = 200$ | $SiH_4:PH_3 = 1:1.0 \times 10^{-3}$ | 0.18 | 2000Å |
| 3 (Amorphous layer (I)) | $SiH_3/He = 1$ | $SiH_4 = 200$ | | 0.18 | 15$\mu$ |
| 4 (Amorphous layer (II)) | Ar | 200 | Si wafer:graphite 1.5:8.5 | 0.3 | 0.5$\mu$ |

Al substrate temperature: 250° C.
Discharging frequency: 13.53 MHz
Inner pressure in reaction chamber :
0.3 Torr during formation of amorphous layer (I)
0.2 Torr during formation of amorphous layer (II)

EXAMPLE 35

By means of the preparation device as shown in FIG. 6, layers were formed on an aluminum substrate under the conditions listed in the following Table.

Other conditions were the same as in Example 34.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image preparation-cleaning steps were repeated. No deterioration of image was observed even after a repetition number of 100,000 or more.

TABLE 36

| Order of layer formation | Conditions | | | | |
|---|---|---|---|---|---|
| | Gases employed | Flow rate (SCCM) | Flow rate ratio (or area ratio) | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 300Å |
| 2 (Rectifying layer) | $SiH_4/He = 1$<br>$PH_3/He = 10^{-2}$ | $SiH_4 = 200$ | $SiH_4:PH_3 = 1:4.0 \times 10^{-3}$ | 0.18 | 800Å |
| 3 (Amorphous layer (I)) | $SiH_4/He = 1$ | $SiH_4 = 200$ | | 0.18 | 15$\mu$ |
| 4 (Amorphous layer (II)) | Ar | 200 | Si wafer:graphite 0.5:9.5 | 0.3 | 0.5$\mu$ |

EXAMPLE 36

By means of the preparation device as shown in FIG. 6, layers were formed on an aluminum substrate under the conditions listed in the following Table.

Other conditions were the same as in Example 34.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a positively charged developer (containing toner and carrier) was cascaded onto the surface of the image forming member, whereby a good toner image with very high density was obtained thereon.

The thus obtained toner image was once subjected to cleaning with a rubber blade and again the above image preparation-cleaning steps were repeated. No deterioration of image was observed even after a repetition number of 150,000 or more.

TABLE 37

| Order of layer formation | Conditions | | | | |
|---|---|---|---|---|---|
| | Gases employed | Flow rate (SCCM) | Flow rate ratio (or area ratio) | Discharging power ($W/cm^2$) | Layer thickness |
| 1 (Interface layer) | $SiH_4/He = 1$ $NH_3$ | $SiH_4 = 10$ | $SiH_4:NH_3 = 1:3$ | 0.18 | 500Å |
| 2 (Rectifying layer) | $SiH_4/He = 1$ $PH_3/He = 10^{-2}$ | $SiH_4 = 200$ | $SiH_4:PH_3 = 1:5.0 \times 10^{-4}$ | 0.18 | 2500Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite 6:4 | 0.3 | 1.5μ |

EXAMPLE 37

An image forming member was prepared according to entirely the same procedure as in Example 36 except for changing the methods for forming the interface layer, the rectifying layer and the amorphous layer (I) as shown in Table 38, and changing the content ratio of silicon atoms to carbon atoms in the second amorphous layer (II) by changing the area ratio of silicon wafer to graphite during formation of the amorphous layer (II). For the thus obtained image forming member, image evaluation was conducted after repeating for about 50,000 times the steps of image making, developing and cleaning as described in Example 34 to obtain the results as shown in Table 39.

TABLE 38

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:1$ | 0.18 | 700Å |
| 2 (Rectifying layer) | $SiH_4/He = 1$ $PH_3/He = 10^{-2}$ | $SiH_4 = 200$ | $SiH_4:PH_3 = 1:3.0 \times 10^{-3}$ | 0.18 | 1500Å |
| 3 (Amorphous layer (I)) | $SiH_4/He = 1$ | $SiH_4 = 200$ | | 0.18 | 15μ |

TABLE 39

| | | | | | | | |
|---|---|---|---|---|---|---|---|
| Si:C Target (area ratio) | 9:1 | 6.5:3.5 | 4:6 | 2:8 | 1:9 | 0.5:9.5 | 0.2:9.8 |
| Si:C (content ratio) | 9:1 | 8.8:1.2 | 7.3:2.7 | 4.8:5.2 | 3:7 | 2:8 | 0.8:9.2 |
| Image quality evaluation | Δ | ○ | ◎ | ◎ | ◎ | ○ | X |

◎ : Very good
○: Good
Δ: Practically satisfactory
X: Liable to form image defect

EXAMPLE 38

Image forming members were prepared according to entirely the same procedure as in Example 34 except for varying the layer thickness of the amorphous layer (II). By repeating the image making, developing and cleaning steps as described in Example 34, the following results were obtained.

TABLE 40

| Thickness of amorphous layer (II) (μ) | Results |
|---|---|
| 0.001 | Image defect liable to occur |
| 0.02 | Substantially no image defect after 20,000 repetitions |
| 0.05 | Stable after 50,000 repetitions or more |
| 1 | Stable after 200,000 repetitions or more |

EXAMPLE 39

An image forming member was prepared according to the same procedure as in Example 34 except for changing the methods for forming the layers other than the amorphous layer (II) to those as shown in the Table below, and evaluation was conducted similarly as in Example 34 to obtain good results.

TABLE 41

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $PH_3/He = 10^{-2}$ | $SiH_4 = 200$ | $SiH_4:PH_3 = 1:5.0 \times 10^{-4}$ | 0.18 | 2500Å |
| 3 (Upper interface layer) | $SiH_4/He = 1$ $NH_3$ | $SiH_4 = 10$ | $SiH_4:NH_3 = 1:10$ | 0.18 | 500Å |
| 4 (Amorphous layer (I)) | $SiH_4/He = 1$ | $SiH_4 = 200$ | | 0.18 | 15μ |

EXAMPLE 40

An image forming member was prepared according to the same procedure as in Example 34 except for changing the methods for forming the layers other than the amorphous layer (II) to those as shown in the Table below, and evaluation was conducted similarly as in Example 34 to obtain good results.

TABLE 42

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$SiF_4/He = 1$<br>$NH_3$ | $SiH_4 = 10$ | $SiH_4:SiF_4:NH_3 = 1:1:30$ | 0.18 | 400Å |
| 2 (Rectifying layer) | $SiH_4/He = 1$<br>$SiF_4/He = 1$<br>$PH_3/He = 10^{-2}$ | $SiH_4 = 100$ | $SiH_4:SiF_4:PH_3 = 1:1:1 \times 10^{-3}$ | 0.18 | 1000Å |
| 3 (Amorphous layer (I)) | $SiH_4/He = 1$ | $SiH_4 = 100$ | $SiH_4:SiF_4 = 1:1$ | 0.18 | 15μ |

TABLE 44

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 500Å |
| 2 (Rectifying layer) | $SiH_4/He = 1$<br>$PH_3/He = 10^{-2}$ | $SiH_4 = 200$ | $SiH_4:PH_3 = 1:1.0 \times 10^{-3}$ | 0.18 | 2000Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$<br>$C_2H_4$ | $SiH_4 = 100$ | $SiH_4:C_2H_4 = 3:7$ | 0.18 | 0.5μ |

Al substrate temperature: 250° C.
Discharging frequency: 13.56 MHz
Inner pressure in reaction chamber:
0.3 Torr during formation of amorphous layer (I)
1.5 Torr during formation of amorphous layer (II)

EXAMPLE 41

Image forming members were prepared according to the same conditions and procedures as in Examples 34, 35, 36, 37, 39 and 40 except that the amorphous layer (I) was formed under the conditions shown in the Table below, and evaluated similarly as in respective Examples to obtain good results.

TABLE 43

| Order of layer formation | Gases employed | Flow rate (SCCM) | Flow rate ratio | Discharging power ($W/cm^2$) | Layer thickness |
|---|---|---|---|---|---|
| Amorphous layer (I) | $SiH_4/He = 1$<br>$B_2H_6/He = 10^{-2}$ | $SiH_4 = 200$ | $SiH_4:B_2H_6 = 1:2 \times 10^{-5}$ | 0.18 | 15 |

EXAMPLE 42

By means of the preparation device as shown in FIG. 5, layers were formed on a drum-shaped aluminum substrate under the conditions listed in the following Table.

The photosensitive drum (image forming member for electrophotography) thus obtained was set in a copying device, subjected to corona charging at ⊖5 KV for 0.2 sec. and irradiated with a light image. As the light source, a tungsten lamp was employed at a dose of 1.0 lux.sec. The latent image was developed with a positively charged developer (containing toner and carrier) and transferred onto a plain paper. The transferred image was found to be very good. The toner remaining on the photosensitive drum without being transferred was subjected to cleaning by a rubber blade before turning to the next cycle of copying. Such a step was repeated for 150,000 times or more, whereby no deterioration of the image was observed.

Example 43

By means of the preparation device as shown in FIG. 5, layers were formed on a drum-shaped aluminum substrate under the conditions listed in the following Table.

Other conditions were the same as in Example 41.

The photosensitive drum thus obtained was set in a copying device, subjected to corona charging at ⊖5 KV for 0.2 sec. and irradiated with a light image. As the light source, a tungsten lamp was employed at a dose of 1.0 lux.sec. The latent image was developed with a positively charged developer (containing toner and carrier) and transferred onto a plain paper. The transferred image was found to be very good. The toner remaining on the photosensitive drum without being transferred was subjected to cleaning by a rubber blade before turning to the next cycle of copying. Such a step was repeated for 100,000 times or more, whereby no deterioration of the image was observed.

TABLE 45

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 300Å |
| 2 (Rectifying layer) | $SiH_4/He = 1$ $PH_3/He = 10^{-2}$ | $SiH_4 = 200$ | $SiH_4:PH_3 = 1:4.0 \times 10^{-3}$ | 0.18 | 800Å |
| 3 (Amorphous layer (I)) | $SiH_4/He = 1$ | $SiH_4 = 200$ | | 0.18 | 15μ |
| 4 (Amorphous layer (II)) | $SiH_4/He = 1$ $C_2H_4$ | $SiH_4 = 15$ | $SiH_4:C_2H_4 = 0.4:9.6$ | 0.18 | 0.3μ |

EXAMPLE 44

By means of the preparation device as shown in FIG. 5, layers were formed on a drum-shaped aluminum substrate under the conditions listed in the following Table.

Other conditions were the same as in Example 41.

The photosensitive drum thus obtained was set in a copying device, subjected to corona charging at ⊖5 KV for 0.2 sec. and irradiated with a light image. As the light source, a tungsten lamp was employed at a dose of 1.0 lux.sec. The latent image was developed with a positively charged developer (containing toner and carrier) and transferred onto a plain paper. The transferred image was found to be very good. The toner remaining on the photosensitive drum without being transferred was subjected to cleaning by a rubber blade before turning to the next cycle of copying. Such a step was repeated for 150,000 times or more, whereby no deterioration of the image was observed.

TABLE 46

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:3$ | 0.18 | 500Å |
| 2 (Rectifying layer) | $SiH_4/He = 1$ $PH_3/He = 10^{-2}$ | $SiH_4 = 200$ | $SiH_4:PH_3 = 1:5.0 \times 10^{-3}$ | 0.18 | 2500Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $C_2H_4$ | $SiH_4 = 100$ | $SiH_4:C_2H_4 = 5:5$ | 0.18 | 1.5μ |

EXAMPLE 45

An image forming member was prepared according to entirely the same procedure as in Example 42 except for changing the methods for forming the other layers other than the amorphous layer (II) as shown in Table 47, and changing the content ratio of silicon atoms to carbon atoms in the second amorphous layer (II) by changing the flow rate ratio of $SiH_4$ gas and $C_2H_4$ gas during formation of the amorphous layer (II). For the thus obtained photosensitive drum, image evaluation was conducted after repeating for about 50,000 times the steps to transfer according to the method as described in Example 42 to obtain the results as shown in Table 48.

TABLE 47

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:1$ | 0.18 | 700Å |
| 2 (Rectifying layer) | $SiH_4/He = 1$ $PH_3/He = 10^{-2}$ | $SiH_4 = 200$ | $SiH_4:PH_3 = 1:3.0 \times 10^{-3}$ | 0.18 | 1500Å |
| 3 (Amorphous layer (I)) | $SiH_4/He = 1$ | $SiH_4 = 200$ | | 0.18 | 15μ |

TABLE 48

| | | | | | | | | |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ◎ | ○ | X |

◎ : Very good
○ : Good
Δ: Practically satisfactory
X: Liable to form image defect

EXAMPLE 46

Layer forming operations were conducted according to entirely the same procedure as in Example 42 except for varying the layer thickness of the amorphous layer (II) as shown in the following Table. The results of evaluation are as shown in the following Table.

TABLE 49

| Thickness of amorphous layer (II) (μ) | Results |
|---|---|
| 0.001 | Image defect liable to occur |
| 0.02 | Substantially no image defect after 20,000 repetitions |
| 0.05 | Substantially no image before after 50,000 repetitions |

TABLE 49-continued

| Thickness of amorphous layer (II) (μ) | Results |
|---|---|
| 2 | Stable after 200,000 repetitions or more |

EXAMPLE 47

Layer forming operations were conducted according to the same procedure as in Example 42 except for changing the methods for forming the interface layer, the rectifying layer and the amorphous layer (I) to those as shown in the Table below, and evaluation was conducted similarly as in Example 42 to obtain good results.

TABLE 52

| Layer formed | Gases employed | Flow rate (SCCM) | Flow rate ratio | Discharging power ($W/cm^2$) | Layer thickness (μ) |
|---|---|---|---|---|---|
| Amorphous layer (I) | $SiH_4/He = 1$<br>$B_2H_6/He = 10^{-2}$ | $SiH_4 = 200$ | $SiH_4:B_2H_6 = 1:2 \times 10^{-5}$ | 0.18 | 15 |

EXAMPLE 48

Layer forming operations were conducted according to the same procedure as in Example 42 except for changing the methods for forming the other layers than the amorphous layer (II) to those as shown in the Table below, and evaluation was conducted similarly as in Example 42 to obtain good results.

TABLE 50

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 500Å |
| 2 (Rectifying layer) | $SiH_4/He = 1$<br>$PH_3/He = 10^{-2}$ | $SiH_4 = 200$ | $SiH_4:PH_3 = 1:5.0 \times 10^{-4}$ | 0.18 | 2500Å |
| 3 (Upper interface layer) | $SiH_4/He = 1$<br>$NH_3$ | $SiH_4 = 10$ | $SiH_4:NH_3 = 1:10$ | 0.18 | 500Å |
| 4 (Amorphous layer (II)) | $SiH_4/He = 1$ | $SiH_4 = 200$ | | 0.18 | 15μ |

EXAMPLE 49

Image forming members were prepared according to the same conditions and procedures as in Examples 42, 43, 44 and 45 except that the amorphous layer (I) was formed under the conditions shown in the Table below, and evaluated similarly as in respective Examples to obtain good results.

TABLE 51

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$SiF_4/He = 1$<br>$NH_3$ | $SiH_4 = 10$ | $SiH_4:SiF_4:NH_3 = 1:1:30$ | 0.18 | 400Å |
| 2 (Rectifying layer) | $SiH_4/He = 1$<br>$SiF_2/He = 1$<br>$PH_3/He = 10^{-2}$ | $SiH_4 = 100$ | $SiH_4:SiF_4:PH_3 = 1:1:1 \times 10^{-3}$ | 0.18 | 1000Å |
| 3 (Amorphous layer (I)) | $SiH_4/He = 1$<br>$SiF_4/He = 1$ | $SiH_4 = 100$ | $SiH_4:SiF_4 = 1:1$ | 0.18 | 15μ |

EXAMPLE 50

By means of the preparation device as shown in FIG. 6, layers were formed on an aluminum substrate under the following conditions.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image preparation-cleaning steps were repeated. No deterioration of image was observed even after a repetition number of 150,000 or more.

TABLE 53

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$<br>$NH_3$ | $SiH_4 = 10$ | $SiH_4:NH_3 = 1:30$ | 0.18 | 500Å |
| 2 (Rectifying layer) | $SiH_4/He = 1$<br>$PH_3/He = 10^{-2}$ | $SiH_4 = 200$ | $SiH_4:PH_3 = 1:1.0 \times 10^{-3}$ | 0.18 | 2000Å |
| 3 | $SiH_4/He = 1$ | $SiH_4 = 200$ | | 0.18 | 15μ |

TABLE 53-continued

| Order of layer formation | Conditions | | | | |
|---|---|---|---|---|---|
| | Gases employed | Flow rate (SCCM) | Flow rate ratio | Discharging power ($W/cm^2$) | Layer thickness |
| (Amorphous layer (I)) | | | | | |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 0\ 1.5:1.5:7$ | 0.18 | 0.5μ |

Al substrate temperature: 250° C.
Discharging frequency: 13.56 MHz
Inner pressure in reaction chamber:
0.3 Torr during formation of amorphous layer (I)
0.5 Torr during formation of amorphous layer (II)

EXAMPLE 51

By means of the preparation device as shown in FIG. 6, layers were formed on an aluminum substrate under the following conditions.

Other conditions were the same as in Example 50.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a positively charged developer (containing toner and carrier) was cascaded onto the surface of the image forming member, whereby a good toner image was obtained thereon.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at a dose of 1.0 lux.sec. using a transmissive type test chart.

Immediately thereafter, a positively charged developer (containing toner and carrier) was cascaded onto the surface of the image forming member, whereby a good toner image with very high density was obtained thereon.

The thus obtained toner image was once subjected to cleaning with a rubber blade and again the above image preparation-cleaning steps were repeated. No deterioration of image was observed even after a repetition number of 150,000 or more.

TABLE 54A

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:3$ | 0.18 | 500Å |
| 2 (Rectifying layer) | $SiH_4/He = 1$ $PH_3/He = 10^{-2}$ | $SiH_4 = 200$ | $SiH_4:PH_3 = 1:5.0 \times 10^{-4}$ | 0.18 | 2500Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 0.5μ |

The thus obtained toner image was once subjected to cleaning with a rubber blade and again the above image preparation-cleaning steps were repeated. No deterioration of image was observed even after a repetition number of 100,000 or more.

EXAMPLE 53

An image forming member was prepared according to entirely the same procedure as in Example 50 except for changing the methods for forming the interface

TABLE 54

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 300Å |
| 2 (Rectifying layer) | $SiH_4/He = 1$ $PH_3/He = 10^{-2}$ | $SiH_4 = 200$ | $SiH_4:PH_3 = 1:4.0 \times 10^{-3}$ | 0.18 | 800Å |
| 3 (Amorphous layer(I)) | $SiH_4/He = 1$ | $SiH_4 = 200$ | | 0.18 | 15μ |
| 4 (Amorphous layer (II) | $SiH_4/He = 0.5$ $SiF_4/He = 0.5$ $C_2H_4$ | $SiH_4 + SiF_4 = 15$ | $SiH_4:SiF_4:C_{12}H_4 = 0.3:0.1:9.6$ | 0.18 | 0.3μ |

EXAMPLE 52

By means of the preparation device as shown in FIG. 6, layers were formed on an aluminum substrate under the following conditions.

Other conditions were the same as in Example 50.

layer, the rectifying layer and the amorphous layer (I) as shown in Table 55, and changing the content ratio of silicon atoms to carbon atoms in the second amorphous layer (II) by changing the flow rate ratios of $SiH_4$, $SiF_4$ and $C_2H_4$ gases during formation of the amorphous layer (II). For the thus obtained image forming member, image evaluation was conducted after repeating for about 50,000 times the steps of image making, developing and cleaning as described in Example 50 to obtain the results as shown in Table 56.

TABLE 55

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $PH_3/He = 10^{-2}$ | $SiH_4 = 200$ | $SiH_4:PH_3 = 1:1.0 \times 110^{-3}$ | 0.18 | 2000Å |
| 3 (Amorphous layer (I)) | $SiH_4/He = 1$ | $SiH_4 = 200$ | | 0.18 | 15μ |

TABLE 56

| | | | | | | | | |
|---|---|---|---|---|---|---|---|---|
| $SiH_4:SiF_4:C_2H_4$ (Flow rate ratio) | 5:4:1 | 3:3.5:3.5 | 2:2:6 | 1:1:8 | 0.6:0.4:9 | 0.2:0.3:9.5 | 0.2:0.3:9.5 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ◎ | ○ | X |

◎: Very good
○: Good
Δ: Practically satisfactory
X: Liable to form image defect

EXAMPLE 54

Image forming members were prepared according to entirely the same procedure as in Example 50 except for varying the film thickness of the amorphous layer (II). By repeating the image making, developing and cleaning steps as described in Example 49, the following results were obtained.

TABLE 57

| Thickness of amorphous layer (II) (μ) | Results |
|---|---|
| 0.001 | Image defect liable to occur |
| 0.02 | Substantially no image defect after 20,000 repetitions |
| 0.05 | Stable after 50,000 repetitions or more |
| 1 | Stable after 200,000 repetitions or more |

EXAMPLE 55

An image forming member was prepared according to the same procedure as in Example 50 except for changing the methods for forming the layers other than the amorphous layer (II) to those as shown in the Table below, and evaluation was conducted similarly as in Example 50 to obtain good results.

TABLE 58

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Lower interface layer) | $SiH_4/He = 1$ $NH_3$ | $SiH_4 = 10$ | $SiH_4:NH_3 = 1:30$ | 0.18 | 500Å |
| 2 (Rectifying layer) | $SiH_4/He = 1$ $PH_3/He = 10^{-2}$ | $SiH_4 = 200$ | $SiH_4:PH_3 = 1:5.0 \times 10^{-4}$ | 0.18 | 2500Å |
| 3 (Upper interface layer) | $SiH_4/He = 1$ $NH_3$ | $SiH_4 = 10$ | $SiH_4:NH_3 = 1:10$ | 0.18 | 500Å |
| 4 (Amorphous layer (I)) | $SiH_4/He = 1$ | $SiH_4 = 200$ | | 0.18 | 15μ |

EXAMPLE 56

An image forming member was prepared according to the same procedure as in Example 50 except for changing the methods for forming the layers other than the amorphous layer (II) to those as shown in the Table below, and evaluation was conducted similarly as in Example 50 to obtain good results.

TABLE 59

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $SiF_4/He = 1$ $NH_3$ | $SiH_4 = 10$ 1:1:30 | $SiH_4:SiF_4:NH_3 = 1:1:30$ | 0.18 | 400Å |
| 2 (Rectifying layer) | $SiH_4/He = 1$ $SiF_4/He = 1$ $PH_3/He = 10^{-2}$ | $SiH_4 = 100$ | $SiH_4:SiF_4:PH_3 = 1:1:1 \times 10^{-3}$ | 0.18 | 1000Å |

TABLE 50-continued

| Order off layer formation | Conditions | | | | |
|---|---|---|---|---|---|
| | Gases employed | Flow rate (SCCM) | Flow rate ratio | Discharging power ($W/cm^2$) | Layer thickness |
| 3 (Amorphous layer (I)) | $SiH_4/He = 1$ $SiF_4/He = 1$ | $SiH_4 = 100$ | $SiH_4:SiF_4 =$ 1:1 | 0.18 | 15μ |

EXAMPLE 57

An image forming member was prepared according to the same procedure as in Example 52 except that the amorphous layer (II) was prepared according to the sputtering method under the following conditions, and evaluated similarly as in the Example 52 to obtain good results.

TABLE 60

| | Gases employed | Flow rate (SCCM) | Area ratio of target Si wafer:graphite | Discharging power ($W/cm^2$) | Layer thickness (μ) |
|---|---|---|---|---|---|
| Amorphous layer (II) . $SiF_4/He = 0.5$ | Ar $SiF_4 = 100$ | Ar = 200 | 2.5:7.5 | 0.3 | 1 |

EXAMPLE 58

Image forming members were prepared according to the same conditions and procedures as in Examples 50, 51, 52, 53 and 55 except that the amorphous layer (I) was formed under the conditions shown in the Table below, and evaluated similarly as in respective Examples to obtain good results.

TABLE 61

| Layer formed | Gases employed | Flow rate (SCCM) | Flow rate ratio | Discharging power ($W/cm^2$) | Layer thickness (μ) |
|---|---|---|---|---|---|
| Amorphous layer (I) | $SiH_4/He = 1$ $B_2H_6/He = 10^{-2}$ | $SiH_4 = 200$ | $SiH_4:B_2H_6 =;0\ 1:2 \times 10^{-5}$ | 0.18 | 15 |

What is claimed is:

1. A photoconductive member which comprises a support for the photoconductive member, an interface layer constituted of an amorphous material containing at least silicon atoms and nitrogen atoms as constituent atoms, a rectifying layer comprising an amorphous material containing atoms (A) belonging to Group III or Group V excepting nitrogen of the Periodic Table as constituent atoms in a matrix of silicon atoms and an amorphous layer exhibiting photoconductivity constituted of an amorphous material containing at least one of hydrogen atoms or halogen atoms as constituent atoms in a matrix of silicon atoms, said rectifying layer having a layer thickness t which is from 30 Å up to, but not reaching, 0.3μ and the content C(A) of said aforesaid atoms contained in the rectifying layer being 30 atomic ppm or more, or said t being 30 Å or more and said C(A) being from 30 atomic ppm, up to, but not reaching, 100 atomic ppm.

2. A photoconductive member according to claim 1, further having an amorphous layer constituted of an amorphous material containing at least silicon atoms and carbon atoms as constituent atoms on the amorphous layer exhibiting photoconductivity.

3. A photoconductive member according to claim 2, wherein the amorphous material containing carbon atoms further contains hydrogen atoms as constituent atoms.

4. A photoconductive member according to claim 2, wherein the amorphous material containing carbon atoms further contains halogen atoms as constituent atoms.

5. A photoconductive member according to claim 2, wherein the amorphous material containing carbon atoms further contains hydrogen atoms and halogen atoms as constituent atoms.

6. A photoconductive member according to claim 1, wherein atoms belonging to the group V of the periodic table are contained in the rectifying layer and atoms belonging to the group III of the periodic table are contained in the amorphous layer exhibiting photoconductivity.

7. A photoconductive member according to claim 1, wherein a substance for controlling the conduction characteristic is contained in the amorphous layer exhibiting photoconductivity.

8. A photoconductive member according to claim 2, wherein said amorphous material containing carbon atoms is selected from the amorphous materials represented by the following general formulae (1) $Si_aC_{1-a}$ wherein $0.1 \leqq a \leqq 0.99999$;

(2) $(Si_bC_{1-b})_cH_{1-c}$ wherein $0.1 \leqq b \leqq 0.99999$ and $0.6 \leqq c \leqq 0.99$; and (3) $(Si_dC_{1-d})_e(X,H)_{1-e}$ wherein $0.1 \leqq d \leqq 0.99999$ and $0.8 \leqq e \leqq 0.99$.

9. A photoconductive member according to claim 2, wherein the thickness of said amorphous layer ranges from 0.003–30 μ.

10. A photoconductive member according to claim 1, wherein the thickness of said amorphous layer exhibiting photoconductivity ranges from 1–100μ.

11. A photoconductive member according to claim 1, wherein said amorphous layer exhibiting photoconductivity contains 1–40 atomic % of hydrogen atoms.

12. A photoconductive member according to claim 1, wherein said amorphous layer exhibiting photoconductivity contains 1–40 atomic % of halogen atoms.

13. A photoconductive member according to claim 1, wherein the sum total content of hydrogen and halogen atoms in said amorphous layer exhibiting photoconductivity ranges from 1–40 atomic %.

14. A photoconductive member according to claim 1, wherein said rectifying layer contains 1–40 atomic % of hydrogen atoms.

15. A photoconductive member according to claim 1, wherein said rectifying layer contains 1-40 atomic % of halogen atoms.

16. A photoconductive member according to claim 1, wherein the sum total content of hydrogen and halogen atoms in said rectifying layer ranges from 1-40 atomic %.

17. A photoconductive member according to claim 1, wherein said atoms (A) are selected from the group consisting of B, Al, Ga, In, Tl, P, As, Sb, and Bi.

18. A photoconductive member according to claim 1, wherein said amorphous material containing nitrogen atoms is selected from the amorphous materials represented by the following general formulae:

(1) $Si_aN_{1-a}$ wherein $0.4 \leqq a \leqq 0.99999$;

(2) $(Si_bN_{1-b})_cH_{1-c}$ wherein $0.43 \leqq b \leqq 0.99999$ and $0.65 \leqq c \leqq 0.98$; and (3) $(Si_dN_{1-d})_e(H,X)_{1-e}$ wherein $0.43 \leqq d \leqq 0.99999$ and $0.8 \leqq e \leqq 0.99$.

19. A photoconductive member according to claim 1, wherein an upper auxiliary layer comprising an amorphous material containing at least silicon and nitrogen atoms is further placed between the rectifying layer and the amorphous layer exhibiting photoconductivity.

* * * * *

UNITED STATES PATENT AND TRADEMARK OFFICE

CERTIFICATE OF CORRECTION

PATENT NO. : 4,522,905

DATED : June 11, 1985

INVENTOR(S) : KYOSUKE OGAWA, ET AL.

It is certified that error appears in the above-identified patent and that said Letters Patent is hereby corrected as shown below:

AT [76] UNDER INVENTORS

"[73] Assignee: Canon Kabushiki Kaisha, Tokyo, Japan" should be inserted.

AT [30] UNDER FOREIGN APPLICATION PRIORITY DATA

Line 4, "Feb. 9, 1982 [JP] Japan.....57-16583" should read --Feb. 4, 1982 [JP] Japan.....57-16583--.

AT [57] IN THE ABSTRACT

Line 13, "which from" should read --which is from--.

COLUMN 1

Line 14, "Arts" should read --Art--.
Line 15, "solid" should read --solid- --.
Line 24, "solid state" should read --solid-state--.
Line 64, "phosphorous" should read --phosphorus--.

COLUMN 2

Line 28, "solid state" should read --solid-state--.
Line 42, "surpass" should read --to surpass--.
Line 67, "bery" should read --very--.

COLUMN 3

Line 19, "t from" should read --t which is from--.
Line 31, "6 schematic" should read --6 show schematic--.

UNITED STATES PATENT AND TRADEMARK OFFICE

CERTIFICATE OF CORRECTION

PATENT NO. : 4,522,905

DATED : June 11, 1985

INVENTOR(S) : KYOSUKE OGAWA, ET AL.

It is certified that error appears in the above-identified patent and that said Letters Patent is hereby corrected as shown below:

COLUMN 5

Line 28, "constituent," should read --constituents,--
Line 50, "inerhalogen" should read --interhalogen--.

COLUMN 7

Line 58, "C(A)>50" should read --C(A)≥50--.

COLUMN 11

Line 11, "suppot" should read --support--.
Line 65, "optionaly" should read --optionally--.

COLUMN 12

Line 7, "strength environmental" should read --strength, environmental--.
Line 11, "302" should read --304--.
Line 54, "of" should read --on--.

COLUMN 14

Line 38, "behaviours" should read --behaviors--.

COLUMN 17

Line 32, "valve" should read --valves--
Line 53, "526 and 529" should read --517 and 519--.

UNITED STATES PATENT AND TRADEMARK OFFICE

CERTIFICATE OF CORRECTION

PATENT NO. : 4,522,905

DATED : June 11, 1985

INVENTOR(S) : KYOSUKE OGAWA, ET AL.

It is certified that error appears in the above-identified patent and that said Letters Patent is hereby corrected as shown below:

COLUMN 21

Line 43, "$SiH_4$/He = 1" should read --$SiH_4$/He = 1--
$NH_3$

Line 51, "occur," should read --occurs,--.
Line 53, "occur," should read --occurs,--.

COLUMN 22

Line 60, "$SiH_4$:$SiF_4$:$NH_3$ = 1:1:30
1:1:30"
should read
--$SiH_4$:$SiF_4$:$NH_3$ = 1:1:30--.

COLUMN 25

Line 19, "charging" should read --changing--.
Line 23, "charging" should read --changing--.

COLUMN 30

Line 46, "500A" should read --700A--.

COLUMN 31

Line 45, "$SiH_4$/He = 0,5" should read --$SiH_4$/He = 0.5--.
$C_2H_4$
$SiF_4$/He = 0.5
$C_2H_4$

COLUMN 33

Line 35, "$SiF_4$He = 0.5" should read --$SiF_4$/He = 0.5--.

UNITED STATES PATENT AND TRADEMARK OFFICE

CERTIFICATE OF CORRECTION

PATENT NO. : 4,522,905

DATED : June 11, 1985

INVENTOR(S) : KYOSUKE OGAWA, ET AL.

It is certified that error appears in the above-identified patent and that said Letters Patent is hereby corrected as shown below:

COLUMN 33

Line 50, "$SiH_4SiF_2:C_2H_4$" should read --$SiH_4:SiF_4:C_2H_4$--.
Line 52, "(content rate)" should read --(content ratio).

COLUMN 34

Line 50, "0.2:0.3" should read --0.2:0.3:9.5--.
Lines 59-60, "oper (containing toner and carrier) was cascaded onto the surface of the image forming member, whereby a" should be moved to COLUMN 34, Lines 1 and 2.

COLUMN 35

Line 54, "$SiF_4He$ = 1" should read --$SiF_4/He$ = 1--.

COLUMN 37

Line 26, "occur," should read --occurs,--.
Line 28, "occur," should read --occurs,--.
Line 58, "$SiF_4He$ = 1" should read $SiF_4/He$ = 1--.
Line 62, "$SiF_4He$ = 1" should read $SiF_4/He$ = 1--.

COLUMN 39

Line 6, "$SiH_4/He$ = 1 $SiH_4$=200 $B_2H_6/He = 10^{-2}$" should read --$SiH_4/He$ = 1 $SiH_4$ = 200 $B_2H_6/He = 10^{-2}$--.
Line 50, "$SiH_3/He$ = 1" should read --$SiH_4/He$ = 1--.

UNITED STATES PATENT AND TRADEMARK OFFICE

CERTIFICATE OF CORRECTION

PATENT NO. : 4,522,905

DATED : June 11, 1985

INVENTOR(S) : KYOSUKE OGAWA, ET AL.

It is certified that error appears in the above-identified patent and that said Letters Patent is hereby corrected as shown below:

COLUMN 43

Line 20, "$SiH_4$/He = 1" should read --$SiH_4$/He = 1--.
$SiF_4$/He = 1

Line 51, "Order of layer formation" should read --Layer formed--.

COLUMN 44

Line 51, "Layer thickness" should --Layer thickness (μ)--.

COLUMN 46

Line 67, "image before after" should read --image defect after--.

COLUMN 47

Line 30, "(Interface layer)" should read --(Lower interface layer)--.

Line 35, "(Amorphous layer (II))" should read --(Amorphous layer (I))--.

Line 51, "$SiF_2$/He = 1" should read --$SiF_4$/He = 1--.

COLUMN 50

Line 5, "= 0 1.5:1.5:7" should read --=1.5:1.5:7--.

Line 60, "$SiH_4$:$SiF_4$:$C_{12}H_4$" should read --$SiH_4$:$SiF_4$:$C_2H_4$--.

UNITED STATES PATENT AND TRADEMARK OFFICE

CERTIFICATE OF CORRECTION

PATENT NO. : 4,522,905

DATED : June 11, 1985

INVENTOR(S) : KYOSUKE OGAWA, ET AL.

It is certified that error appears in the above-identified patent and that said Letters Patent is hereby corrected as shown below:

COLUMN 51

Line 12, "$110^{-3}$" should read --$10^{-3}$--.

Line 63, "(Interface layer) $SiF_4$/He = 1 $SiH_4$/He = 1"

should read

--(Interface layer) $SiH_4$/He = 1 $SiF_4$/He = 1--.

Line 63, "$SiH_4$ = 10" should read --$SiH_4$ = 10--.
1:1:30

COLUMN 53

Line 1, "TABLE 50-continued" should read --TABLE 59-continued--.

Line 3, "off" should read --of--.

Line 15, "in the Example" should read --in Example--.

Line 21, "Amorphous layer (II) $SiF_4$/He = 0.5 Ar $SiF_4$ = 100 Ar = 200"

should read

--Amorphous layer (II) $SiF_4$/He = 0.5 Ar $SiF_4$ = 100 Ar = 200--.

UNITED STATES PATENT AND TRADEMARK OFFICE

CERTIFICATE OF CORRECTION

PATENT NO. : 4,522,905

DATED : June 11, 1985

INVENTOR(S) : KYOSUKE OGAWA, ET AL.

It is certified that error appears in the above-identified patent and that said Letters Patent is hereby corrected as shown below:

COLUMN 53

Line 56, "ppm, up" should read --ppm up--

COLUMN 54

Line 36, "=;0 1:2 X $10^{-5}$" should read --=1:2 X $10^{-5}$--.

Signed and Sealed this

Twenty-ninth Day of December, 1987

*Attest:*

DONALD J. QUIGG

*Attesting Officer*

*Commissioner of Patents and Trademarks*